US011479966B2

(12) United States Patent
Lefkus

(10) Patent No.: US 11,479,966 B2
(45) Date of Patent: Oct. 25, 2022

(54) BUILDING ELEMENTS AND STRUCTURES HAVING MATERIALS WITH SHIELDING PROPERTIES

(71) Applicant: John Lefkus, Annandale, NJ (US)

(72) Inventor: John Lefkus, Annandale, NJ (US)

(73) Assignee: John Lefkus, Annandale, NJ (US)

( * ) Notice: Subject to any disclaimer, the term of this patent is extended or adjusted under 35 U.S.C. 154(b) by 0 days.

(21) Appl. No.: 17/390,113

(22) Filed: Jul. 30, 2021

(65) Prior Publication Data

US 2022/0034084 A1 Feb. 3, 2022

Related U.S. Application Data

(60) Provisional application No. 63/058,679, filed on Jul. 30, 2020, provisional application No. 63/058,639, filed on Jul. 30, 2020.

(51) Int. Cl.

| | |
|---|---|
| ***E04B 1/92*** | (2006.01) |
| ***E04H 9/04*** | (2006.01) |
| ***F41H 5/24*** | (2006.01) |

(52) U.S. Cl.

CPC ..... *E04B 1/92* (2013.01); *E04H 9/04* (2013.01); *F41H 5/24* (2013.01); *E04B 2001/925* (2013.01)

(58) Field of Classification Search

CPC ..... E04B 1/92; E04B 2001/925; E04H 9/04; F41H 5/24

See application file for complete search history.

(56) References Cited

U.S. PATENT DOCUMENTS

| | | | | |
|---|---|---|---|---|
| 3,375,321 | A * | 3/1968 | Laing | E04B 1/92 174/385 |
| 4,074,141 | A * | 2/1978 | Bryant | G21F 1/125 250/517.1 |
| 4,514,640 | A * | 4/1985 | Bagnell | G21F 3/00 250/517.1 |
| 4,823,523 | A * | 4/1989 | Coupard | H05K 9/0001 52/202 |
| 5,146,047 | A * | 9/1992 | Nagata | C04B 22/002 174/388 |
| 6,973,758 | B2 | 12/2005 | Zeik et al. | |
| 7,655,249 | B2 | 2/2010 | Gaiger et al. | |
| 9,027,297 | B2 | 5/2015 | Lefkus, III et al. | |
| 9,171,649 | B2 | 10/2015 | Zeik et al. | |
| 10,878,974 | B2 | 12/2020 | Ford et al. | |

(Continued)

*Primary Examiner* — Patrick J Maestri
(74) *Attorney, Agent, or Firm* — The Webb Law Firm

(57) ABSTRACT

A shielding system includes a plurality of transportable modules, wall panels, or pods that are connectable to form a containment area and to define a radiation barrier. Each of the plurality of transportable modules has a first radiation wall defining the containment area, a second radiation wall spaced apart from the second wall, and a radiation shielding fill material positioned between the first radiation shielding wall and the second radiation shielding wall. The radiation shielding fill material includes one of a superabsorbent polymer (SAP) filling a portion of a void between the first radiation wall and the second radiation wall, or a non-Newtonian fluid completely filling the void between the first radiation wall and the second radiation wall. A quantity of the radiation shielding fill material is sufficient to substantially reduce measurable radiation level outside the containment area.

20 Claims, 13 Drawing Sheets

(56) References Cited

U.S. PATENT DOCUMENTS

| | | | | |
|---|---|---|---|---|
| 2002/0166293 | A1* | 11/2002 | Zeik | E04B 1/92 52/79.1 |
| 2009/0071322 | A1* | 3/2009 | Oxford | F41H 5/0457 89/36.02 |
| 2012/0186870 | A1* | 7/2012 | Portales Reig | D06M 11/83 174/393 |
| 2013/0111825 | A1* | 5/2013 | Lefkus, III | E04H 3/08 52/79.1 |
| 2014/0224677 | A1* | 8/2014 | Kim | G21F 1/12 206/205 |

* cited by examiner

BUILDING ELEMENTS AND STRUCTURES HAVING MATERIALS WITH SHIELDING PROPERTIES

CROSS-REFERENCE TO RELATED APPLICATION

The present application claims priority to U.S. Provisional Patent Application No. 63/058,679, filed Jul. 30, 2020, and U.S. Provisional Patent Application No. 63/058,639, filed Jul. 30, 2020, the disclosures of which are incorporated herein by reference in their entirety.

BACKGROUND OF THE DISCLOSURE

Field of the Disclosure

The present disclosure relates to the field of radiation, ballistic, ordinance, and/or blast shielding, and more specifically to rapidly deployable facilities having materials with radiation, ballistic, and/or blast shielding properties. The present disclosure further relates to radiation shielding materials for neutron attenuation alone or in combination with other shielding properties. The present disclosure further relates to radiation treatment facilities, including temporary radiation treatment facilities, sensitive electronic and communication facilities, and energy facilities. In some embodiments or aspects, the present disclosure provides logistical advantages to temporary radiation treatment facilities by changing volume and mass readily.

Description of Related Art

Logistics to shield controlled doses of radiation from a radiation generating source are used in radiation therapies for the diagnosis and treatment of patients in a radiotherapy medical facility. Doctors and/or health care professionals and/or technicians working in the radiotherapy medical facility, or people merely in the surrounding area near the radiotherapy medical facility need to be protected from the harmful effects of the generated radiation. Equipment and/or persons inside a structure may seek protection from the harmful effects of external radiation. Radiation shielding is traditionally used to isolate the radiation generation source in the radiotherapy medical facility from the surrounding area and provide some protection from the radiation levels associated with normal use of the equipment and also, to some extent, in the event of accidents occurring with the radiation generating source equipment. For most medical therapies, only low energy neutron attenuation was typically required. With the increased use of proton therapies and hadron therapies using other ions such as carbon, significant neutron energies are experienced, thereby making typical mass solutions for temporary, mobile and tactical buildings ineffective.

A typical radiation shielding, which is in a form of concrete walls, concrete blocks, granular fills, lead or mounds of dirt, may limit the feasibility of building temporary, mobile, and/or tactical facilities in many locations. Logistics for marshaling materials and equipment along with a facility are nonexistent in many urban cities planned around non-vehicular traffic. Similarly, remote areas are without equipment resources and reliable raw materials. The feasibility limitation may be due to a high transportation cost of transporting, for example, hundreds or thousands of concrete blocks from a producer to the location where such temporary facility is desired. For example, the feasibility limitation may be also due to sufficient integration of the radiation shielding material within the modular buildings structures to achieve a sufficient level of the radiation energy containment within the structure of the temporary facility.

Forms of radiation shielding, as well as various forms of ballistic, blast, and ordinance protection, requires large volumes of mass, typically concrete and steel to shield occupants and/or equipment from the destructive force of a threat. The ability to transport high energy radiation medical devices or to protect sensitive electronics and people on a temporary or mobile basis, is impaired by the need to transport and handle the large volume of mass. Once a facility is placed, the removal of the facility requires the same challenges of transporting and handling of this mass during construction of the facility.

For temporary and mobile radiotherapy facilities that may be used for a short time at multiple locations, concrete blocks or granular fills used for radiation shielding within the building structures may need to be transported, placed within and/or around the facility, then removed and transported again. Maintaining an exemplary road weight limitation of 40,000-pound (20 ton) loads may require about 25-40 trucks to transport the radiation shielding for a single radio facility building structure, which causes a single assembly/removal of the radiation shielding fill material at a particular location to be very expensive (e.g., about $100,000-150,000, for example).

The challenge for transportable shielding enclosures capable of stopping radiation levels of 20 MeV or less, which is typical in therapeutic radiation, is the large amount of mass which has to accompany the facilities to achieve safe shielding levels. Even the transportation of aggregates, and their removal makes the logistics difficult. In high density urban areas, the space to store and place large volumes of materials simply does not exist. In remote area and developing nations, equipment to handle the large volumes of mass may not exist and the quality of available aggregates is unknown. Accordingly, there is a need in the art for a transportable shielding enclosure that is cost-effective to transport, set up, and remove, and is effective is providing shielding from radiation levels associated with conventional radiotherapy facilities.

In weapons technology, particle beam weapons, such as ion cannons or proton beams, require shielding of sensitive electronic devices, which may be disabled if exposed to high energy neutrons from a particle beam weapon. Due to the high energy of these weapon systems, shielding systems must have several feet of concrete in order to adequately protect the electronic devices. This is often cost prohibitive and/or logistically impossible. The ability to deploy facilities housing sensitive equipment without the use of concrete or volumes of aggregate provides tactical solutions.

In the nuclear industry, Small Modular Reactors (SMRs) are configured to generate nuclear power on a small scale. A disadvantage of these systems is the inability ability to efficiently and cost effectively attenuate high energy neutrons without huge mass of concrete.

In the communications industry, cloud/sever farm operations often require shielding sensitive and critical electronics from exposure to a burst of electromagnetic radiation from even non-nuclear devices. Military communication facilities may further require ballistic and blast protection. It would be desirable to protect such operations without adding significant mass and volume.

In certain non-destructive testing industries that utilize high-energy x-ray machines, large pieces must be inspected locally, which makes setting up traditional shielding enclosures task expensive and time consuming.

Accordingly, there is a need in the art for rapidly deployable facilities having materials with radiation, ballistic, and/or blast shielding properties.

SUMMARY OF THE DISCLOSURE

In view of the need in the prior art, an object of the present disclosure is to provide rapidly deployable facilities having materials with radiation, ballistic, ordinance, and/or blast shielding properties.

In some non-limiting embodiments or aspects of the present disclosure, a shielding facility may include a plurality of transportable modules, wall panels, or pods connectable to form a containment area and defining a radiation barrier. Each of the plurality of transportable modules may include a first radiation wall defining the containment area, a second radiation wall spaced apart from the second wall, and a radiation shielding fill material positioned between the first radiation shielding wall and the second radiation shielding wall. The radiation shielding fill material may include a superabsorbent polymer (SAP) filling a portion of a void between the first radiation wall and the second radiation wall. A quantity of the radiation shielding fill material may be sufficient to substantially reduce measurable radiation level outside the containment area when a remainder of the void is filled with a liquid such that the SAP absorbs at least a portion of the liquid.

In some non-limiting embodiments or aspects of the present disclosure, the plurality of transportable modules may include one or more sidewall modules connectable together to define vertical walls of the shielding facility and one or more roof modules connectable to an upper end of the one or more sidewall modules. At least one truss may span between opposing sidewall modules and may be configured for supporting at least one of the one or more roof modules. The shielding facility further may include a foundation having a plurality of elongated beams arranged in a pattern corresponding to a floor plan of the shielding facility, wherein each of the elongated beams is configured for supporting the one or more sidewall modules. A shielded door may be provided on at least one of the sidewall modules. A thickness of each of the plurality of transportable modules may be 0.5 meter to 6 meters.

In some non-limiting embodiments or aspects of the present disclosure, at least a second set of transportable modules may surround the plurality of transportable modules. The SAP may be a synthetic SAP, a semi-synthetic SAP, or a natural SAP. The SAP may include elements configured for enhancing an absorption of radiative energy.

In some non-limiting embodiments or aspects of the present disclosure, a shielding facility may include a plurality of transportable modules, wall panels, or pods connectable to form a containment area and defining a radiation barrier. Each of the plurality of transportable modules may include a first radiation wall defining the containment area, a second radiation wall spaced apart from the second wall, and a radiation shielding fill material positioned between the first radiation shielding wall and the second radiation shielding wall. The radiation shielding fill material may include a non-Newtonian fluid filling a void between the first radiation wall and the second radiation wall. The non-Newtonian fluid may be configured to substantially reduce measurable radiation level outside the containment area.

In some non-limiting embodiments or aspects of the present disclosure, the plurality of transportable modules or wall panels may include one or more sidewall modules connectable together to define vertical walls of the shielding facility and one or more roof modules connectable to an upper end of the one or more sidewall modules. At least one truss may span between opposing sidewall modules and may be configured for supporting at least one of the one or more roof modules. Where vertical protection is required, modules could be suspended between the walls instead of trusses allowing for shielding fill. The shielding facility further may include a foundation having a plurality of elongated beams arranged in a pattern corresponding to a floor plan of the shielding facility, wherein each of the elongated beams is configured for supporting the one or more sidewall modules. A shielded door may be provided on at least one of the sidewall modules. A thickness of each of the plurality of transportable modules may be 0.5 meter to 6 meters. Width and height of the transportable modules may be any desired dimension. In some embodiments or aspects, the width and heights of the transportable modules may be selected to facilitate transport via conventional transportation means. To meet the desired height and width requirements, a plurality of transportable modules may be used.

In some non-limiting embodiments or aspects of the present disclosure, the non-Newtonian fluid may be a rheopectic fluid, a thixotropic fluid, a dilatant fluid, a pseudoplastic fluid, or any combination thereof. The non-Newtonian fluid may have ballistic- and blast-proof properties.

In some non-limiting embodiments or aspects of the present disclosure, a method of constructing a modular shielding facility may include connecting a plurality of transportable modules, wall panels, or pods to form a containment area and defining a continuous radiation barrier. Each of the plurality of transportable modules may have a first radiation wall defining the containment area, and a second radiation wall spaced apart from the second wall. The method further may include filling a void between the first radiation shielding wall and the second radiation shielding wall with a radiation shielding fill material. The radiation shielding fill material may include one of a superabsorbent polymer (SAP) filling a portion of a void between the first radiation wall and the second radiation wall and a non-Newtonian fluid filling the entire void between the first radiation wall and the second radiation wall. The method further may include removing at least a portion of the radiation shielding fill material from the void prior to disassembling the plurality of modules.

In other non-limiting embodiments or aspects, the present disclosure may be characterized by one or more of the following numbered clauses.

Clause 1: A shielding facility comprising: a plurality of transportable modules, wall panels, or pods connectable to form a containment area and defining a radiation barrier, each of the plurality of transportable modules comprising: a first radiation wall defining the containment area; a second radiation wall spaced apart from the second wall; and a radiation shielding fill material positioned between the first radiation shielding wall and the second radiation shielding wall, wherein the radiation shielding fill material comprises a superabsorbent polymer (SAP) filling a portion of a void between the first radiation wall and the second radiation wall, and wherein a quantity of the radiation shielding fill material is sufficient to substantially reduce measurable radiation level outside the containment area when a remainder of the void is filled with a liquid such that the SAP absorbs at least a portion of the liquid.

Clause 2: The shielding facility according to clause 1, wherein the plurality of transportable modules comprises one or more sidewall modules connectable together to define vertical walls of the shielding facility and one or more roof modules connectable to an upper end of the one or more sidewall modules.

Clause 3: The shielding facility according to clause 2, further comprising at least one truss spanning between opposing sidewall modules and configured for supporting at least one of the one or more roof modules.

Clause 4: The shielding facility according to clause 2 or 3, further comprising a foundation having a plurality of elongated beams arranged in a pattern corresponding to a floor plan of the shielding facility, wherein each of the elongated beams is configured for supporting the one or more sidewall modules.

Clause 5: The shielding facility according to any of clauses 2 to 4, further comprising a shielded door on at least one of the sidewall modules.

Clause 6: The shielding facility according to any of clauses 1 to 5, wherein a thickness of each of the plurality of transportable modules is 0.5 meter to 6 meters.

Clause 7: The shielding facility according to any of clauses 1 to 6, further comprising at least a second set of transportable modules surrounding the plurality of transportable modules.

Clause 8: The shielding facility according to any of clauses 1 to 7, wherein the SAP is a synthetic SAP, a semi-synthetic SAP, or a natural SAP.

Clause 9: The shielding facility according to any of clauses 1 to 8, wherein the SAP comprises elements configured for enhancing an absorption of radiative energy.

Clause 10: A shielding facility comprising: a plurality of transportable modules, wall panels, or pods connectable to form a containment area and defining a radiation barrier, each of the plurality of transportable modules comprising: a first radiation wall defining the containment area; a second radiation wall spaced apart from the second wall; and a radiation shielding fill material positioned between the first radiation shielding wall and the second radiation shielding wall, wherein the radiation shielding fill material comprises a non-Newtonian fluid filling a void between the first radiation wall and the second radiation wall, and wherein the non-Newtonian fluid is configured to substantially reduce measurable radiation level outside the containment area.

Clause 11: The shielding facility according to clause 10, wherein the plurality of transportable modules comprises one or more sidewall modules connectable together to define vertical walls of the shielding facility and one or more roof modules connectable to an upper end of the one or more sidewall modules.

Clause 12: The shielding facility according to clause 11, further comprising at least one truss spanning between opposing sidewall modules and configured for supporting at least one of the one or more roof modules.

Clause 13: The shielding facility according to clause 11 or 12, further comprising a foundation having a plurality of elongated beams arranged in a pattern corresponding to a floor plan of the shielding facility, wherein each of the elongated beams is configured for supporting the one or more sidewall modules.

Clause 14: The shielding facility according to any of clauses 11 to 13, further comprising a shielded door on at least one of the sidewall modules.

Clause 15: The shielding facility according to any of clauses 10 to 14, wherein a thickness of each of the plurality of transportable modules is 0.5 meter to 6 meters.

Clause 16: The shielding facility according to any of clauses 10 to 15, further comprising at least a second set of transportable modules surrounding the plurality of transportable modules.

Clause 17: The shielding facility according to any of clauses 10 to 16, wherein the non-Newtonian fluid is a rheopectic fluid, a thixotropic fluid, a dilatant fluid, a pseudoplastic fluid, or any combination thereof.

Clause 18: The shielding facility according to any of clauses 10 to 17, wherein the non-Newtonian fluid has ballistic- and blast-proof properties.

Clause 19: A method of constructing a modular shielding facility, the method comprising: connecting a plurality of transportable modules, wall panels or pods to form a containment area and defining a radiation barrier, each of the plurality of transportable modules comprising: a first radiation wall defining the containment area; and a second radiation wall spaced apart from the second wall; and filling a void between the first radiation shielding wall and the second radiation shielding wall with a radiation shielding fill material, wherein the radiation shielding fill material comprises one of a superabsorbent polymer (SAP) filling a portion of a void between the first radiation wall and the second radiation wall and a non-Newtonian fluid filling the entire void between the first radiation wall and the second radiation wall.

Clause 20: The method according to clause 19, further comprising removing at least a portion of the radiation shielding fill material from the void prior to disassembling the plurality of modules.

BRIEF DESCRIPTION OF THE DRAWINGS

Some embodiments or aspects of the disclosure are herein described, by way of example only, with reference to the accompanying drawings. With specific reference now to the drawings in detail, it is stressed that the embodiments or aspects shown are by way of example and for purposes of illustrative discussion of embodiments or aspects of the disclosure. In this regard, the description taken with the drawings makes apparent to those skilled in the art how embodiments or aspects of the disclosure may be practiced.

Figure 1:
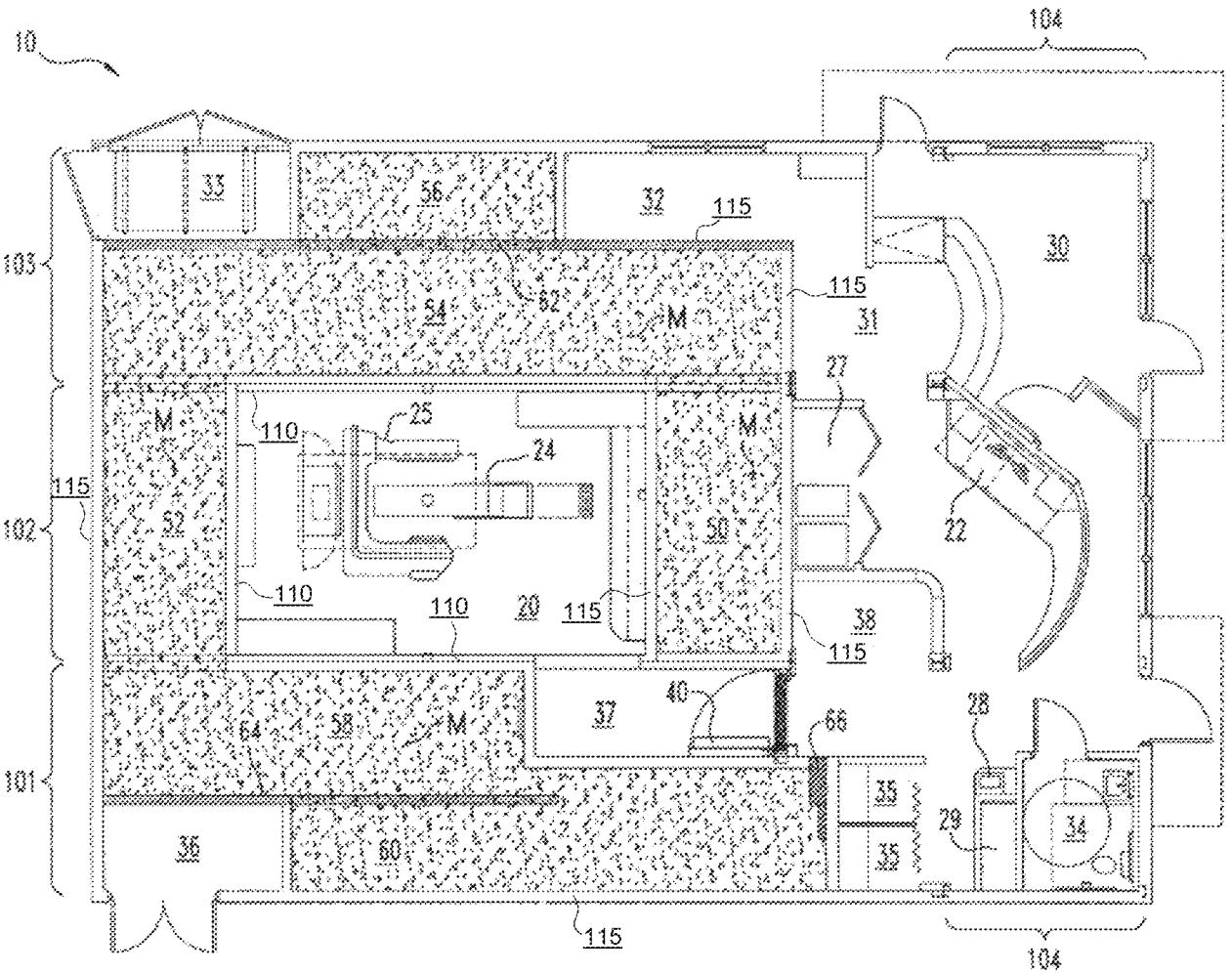
FIG. 1 is a floor plan of a first exemplary modular facility, in accordance with one or more embodiments or aspects of the present disclosure.

It will be appreciated that FIGS. 1-13 are schematic drawings and features are not necessarily drawn to scale.

DETAILED DESCRIPTION

Among those benefits and improvements that have been disclosed, other objects and advantages of this disclosure will become apparent from the following description taken in conjunction with the accompanying figures. Detailed embodiments or aspects of the present disclosure are disclosed herein; however, it is to be understood that the disclosed embodiments or aspects are merely illustrative of the disclosure that may be embodied in various forms. In addition, each of the examples given regarding the various embodiments or aspects of the disclosure which are intended to be illustrative, and not restrictive.

Throughout the specification and claims, the following terms take the meanings explicitly associated herein, unless the context clearly dictates otherwise. The phrases "in one embodiment or aspect," "in an embodiment or aspect," and "in some embodiments or aspects" as used herein do not necessarily refer to the same embodiment(s), though it may. Furthermore, the phrases "in another embodiment or aspect" and "in some other embodiments or aspects" as used herein do not necessarily refer to a different embodiment, although it may. All embodiments or aspects of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, terms such as "consisting of" and "composed of" limit the scope of a specific claim to the materials and steps recited by the claim.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements. All documents referred to herein are "incorporated by reference" in their entirety. The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C. The word "comprising" and "comprises", and the like, does not exclude the presence of elements or steps other than those listed in any claim or the specification as a whole. In the present specification, "comprises" means "includes" and "comprising" means "including".

The discussion of various embodiments or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various embodiments or aspects and aspects described herein. The disclosure comprises, consists of, or consists essentially of, the following embodiments or aspects, in any combination. Various embodiments or aspects of the disclosure are illustrated in separate drawing figures. However, it is to be understood that this is simply for ease of illustration and discussion. In the practice of the disclosure, one or more embodiments or aspects shown in one drawing figure can be combined with one or more embodiments or aspects shown in one or more of the other drawing figures.

As used herein, a "Non-Newtonian fluid" is a fluid that has a viscosity that varies as a function of an applied stress on the fluid. In some embodiments, the applied stress is a shear stress. In some embodiments, the applied stress is a normal stress.

As used herein, a "rheopectic fluid" is a fluid that has a viscosity that increases with an increasing duration of an applied stress.

As used herein, a "thixotropic fluid" is a fluid that has a viscosity that decreases with an increasing duration of an applied stress.

As used herein, a "dilatant fluid" is a fluid that has a viscosity that increases with an increasing magnitude of an applied stress.

As used herein, rheopectic and "dilatant fluids may be referred to collectively "shear thickening fluids." As used herein, pseudoplastic and thixotropic fluids may be referred to collectively "shear thinning fluids."

As used herein, a "Non-Newtonian fluid precursor" is a component that forms a non-Newtonian fluid upon addition of a liquid such as, but not limited to, water.

As used herein, a "superabsorbent polymer" or "(SAP)" is a polymer that can absorb at least a certain weight amount of a liquid relative to an initial weight of the SAP.

All prior patents, publications, and test methods referenced herein are incorporated by reference in their entireties. Specifically, U.S. Pat. Nos. 6,973,758, 7,655,249, 9,027,297, 9,171,649, and 10,878,974 are incorporated herein by reference in their entirety for all purposes.

In some embodiments or aspects, various modular building structures of the present disclosure can be permanent and/or in temporary radiotherapy facilities that house radiation generation source(s) (e.g., linear accelerator, hadron source, X-ray source, proton and/or neutron beam source, industrial X-Ray or radiography CT scanners, etc.). In some embodiments or aspects, temporary radiotherapy facilities may be used, for example, when permanent radiotherapy facilities need maintenance. In some embodiments or aspects, an exemplary temporary facility, also referred to herein as a temporary radiation vault (TRV), may be set up near to the permanent facility to prevent a reduction in patient throughput at a particular location by using the TRV in place of a permanent radiotherapy facility that is under maintenance. In some embodiments or aspects, TRVs may also be used in remote locations where health care delivery may be limited. In some embodiments or aspects, various modular building structures of the present disclosure can be permanent and/or in temporary facilities that house electronic and/or communications equipment and provide radiation, hadron particles, blast, ordinance, and/or ballistic protection.

Accordingly, some embodiments or aspects of the present disclosure herein are directed to various fill materials for use in these facilities, particularly for mobile radiotherapy and TRVs. Although exemplary embodiments or aspects herein use a radiotherapy facility, it should be understood by one skilled in the art that these exemplary embodiments or aspects are merely for conceptual clarity, and not by way of limitations the embodiments or aspects taught herein. The embodiments or aspects may include any facility for shielding radiation for any application by the use of SAP or a non-Newtonian fluid introduced into the walls of the facility (e.g., computer equipment, military equipment, etc.). Further embodiments or aspects may include any facility for blast and/or ballistic shielding provided by the use of SAP or a non-Newtonian fluid introduced into the walls of the facility. Further embodiments or aspects may include any facility for radiation, blast, and ballistic shielding provided by the use of SAP or a non-Newtonian fluid introduced into the walls of the facility.

FIG. 1 is a floor plan of a first exemplary modular facility 10 in accordance with one or more embodiments or aspects of the present disclosure. The facility 10 may include a treatment room 20 including a radiotherapy device 25 (the radiation generation source) and a control station 22 for the radiotherapy device 25. The interior of facility 10 may include a waiting area 30, reception/scheduling area 31, gowning area 35, restroom 34, and storage areas 32, 38. The mechanical area 33 may contain any necessary heating and chiller equipment and may be accessed externally, as is an additional storage area 36. Facility 10 may include an electrical closet 27, staff sink 28 and a potable waste liquid (e.g., water) tanks 29.

Access to treatment room 20 may be via a radiation shielded door 40 and corridor 37. Once inside the treatment room 20, the patient lies on the treatment table 24 and the radiotherapy is may be administered via radiotherapy device 25 in accordance with the treatment parameters input by the operator at the control station 22. The features of the floor plan of facility 10 as shown in the embodiments or aspects of FIG. 1 may be a permanent and/or a temporary radiotherapy building structure.

For example, facility 10 may be a temporary radiotherapy facility, such as a TRV, which may be constructed from a number of prefabricated modules so as to speed the modularly assembly and disassembly of the temporary radiotherapy facility. In the embodiment shown in FIG. 1, the ground floor may include four different modules, each of which has a pre-determined footprint (e.g., substantially rectangular footprint) based on desired engineering and/or architectural specifications of the temporary radiotherapy facility. Modules 101, 102 and 103 may be equal in length, for example, and may be placed along-side each other. Module 104 may be placed across the ends of modules 101, 102, and 103 (right side of FIG. 1). In some embodiments or aspects, any number of different modules of any suitable, pre-determined shapes/and sizes may be arranged in any suitable configuration to achieve the desired engineering and/or architectural specifications of the temporary radiotherapy facility. For example, the treatment room may be entirely contained within module 102.

In some embodiments or aspects, modules 101, 102 and 103 may be designed such that, when assembled, the assembled modules define a number of void spaces 50, 52, 54, 56, 58, and 60 around the treatment room 20. These void spaces may be designed to be filled with a radiation shielding fill material M. Furthermore, modules 101, 102 and 103 provide inner walls 110 of treatment room 20 forming a first radiation shielding wall and outer walls 115 forming a second radiation shielding wall. Thus, radiation shielding fill material M may fill void spaces 50, 52, 54, 56, 58, and 60 and positioned between the first radiation shielding wall and the second radiation shielding wall. A shielding barrier, or radiation shielding barrier, may be formed from the first radiation shielding wall and the second radiation shielding wall.

While FIG. 1 is directed to a modular facility, in other embodiments or aspects, the facility may be an existing structure wherein additional walls or panels are provided to impart radiation, ballistic, and/or blast properties to an existing structure.

In some embodiments or aspects, radiation shielding fill material M may include SAP(s) as described herein. In this manner, using SAP(s) as some portion of or the only radiation shielding fill material, only, for example, without limitation, a relative low weight amount of SAP(s) (e.g., 6-8 tons) may be shipped to a site on which facility 10 is to be constructed. SAP in solid form may be introduced into void spaces 50, 52, 54, 56, 58, and 60 around treatment room 20, for example, and a predefined quantity of a liquid (e.g., water) may be pumped into the void spaces with the introduced solid form SAP so as to convert the solid SAP into a gel or sol. The SAP gel or sol may have a mass of 600 times the original mass of the introduced SAP in solid form. This gel may be used to fill void spaces 50, 52, 54, 56, 58, and 60. The use of SAP as a radiation shielding fill material M in this manner, may result in transport cost savings. The precise quantity and desired distribution of radiation shielding fill material M is dependent on the characteristics of the radiation emitted from device 25.

In various embodiments or aspects, an amount of liquid may be 10-100 times an initial SAP weight used to fill the void spaces, where the initial SAP weight is the weight of the SAP before introduction of the liquid. An amount of liquid may be 100-1,000 times the initial SAP weight used to fill the void spaces. An amount of liquid may be 1,000-10,000 times the initial SAP weight used to fill the void spaces. An amount of liquid may be 10,000-100,000 times the initial SAP weight used to fill the void spaces. An amount of liquid may be 100,000-1,000,000 times the initial SAP weight used to fill the void spaces. An amount of liquid may be 1,000,000-10,000,000 times the initial SAP weight used to fill the void spaces.

Furthermore, adjacent void spaces (e.g. 50 and 54, 54 and 52, 52 and 58) may be in fluid communication such that, once filled with the radiation shielding fill material M, a substantially continuous radiation barrier of radiation shielding fill material M may be formed around treatment room 20. By remaining in a perpetually flowable state, such as a viscous SAP gel, for example, the radiation shielding fill material M, may not crack due to settling or seismic events.

In some embodiments or aspects, the radiation shielding fill material M may include SAP along with any suitable type of radiation shielding fill material, such as metal sheets, granular fill, sand, cement, concrete, and the like, that may be introduced into the voids. The SAP gel may also provide physical support for the other types of radiation shielding fill material used in the voids.

In some embodiments or aspects, the radiation shielding fill material M may include a solid form SAP that is present in a mixture with metallic or high atomic number element particles, such as lead, tungsten, or bismuth, for example, that may be used to attenuate ionizing radiation (gamma, X-ray, and/or high ultraviolet radiation). The elements used in the mixture may be tailored to the type of radiation used.

In some embodiments, radiation shielding fill material M may include a non-Newtonian fluid as described herein. In this manner, using non-Newtonian fluids as some portion of or the only radiation shielding fill material, only, for example, without limitation, any number of different modules may be shipped to a site on which facility 10 is to be constructed. Non-Newtonian fluid(s) may be pumped into void spaces 50, 52, 54, 56, 58, and 60 around treatment room 20. The precise quantity and desired distribution of radiation shielding fill material M is dependent on the characteristics of the radiation emitted from device 25.

In some embodiments, only a non-Newtonian fluid may be used to fill the void spaces.

In some embodiments, any suitable amount of non-Newtonian fluid may be used to fill the void spaces with radiation shielding fill material M along with other types of radiation shielding fill material, such as cement, concrete, metal shielding, super absorbent polymers (SAP), and the like.

Furthermore, adjacent void spaces (e.g. 50 and 54, 54 and 52, 52 and 58) may be in fluid communication such that, once filled with the radiation shielding fill material M, a substantially continuous radiation barrier of radiation shielding fill material M may be formed around treatment room 20. By remaining in a perpetually flowable state, such as a non-Newtonian fluid, for example, the radiation shielding fill material M, may not crack or rupture due to settling or seismic events, particularly if the non-Newtonian fluid is a shear thickening fluid as described herein. For instance, when the radiation shielding fill material M is a shear thickening fluid, the viscosity may increase with application of an applied stress stemming from the seismic event. This increase in viscosity may in some embodiments, provide structural integrity to the fill material M, so as to prevent cracking and rupturing.

In some embodiments, the radiation shielding fill material M may include a non-Newtonian fluid along with any suitable type of radiation shielding fill material, such as metal sheets, granular fill, sand, cement, concrete, and the like, that may be introduced into the voids. The non-Newtonian fluid may also provide physical support for the other types of radiation shielding fill material used in the voids.

In one particular non-limiting embodiment, the non-Newtonian fluid may be formed by adding a liquid (e.g., water) to a non-Newtonian fluid precursor, such as but not limited to, a plurality of particles. For instance, the plurality of particles may comprise cornstarch, such that addition of water results in the formation of a dilatant fluid comprising a suspension of the cornstarch in water. In another example, the plurality of particles may comprise gypsum particles such that the addition of water results in the formation of a rheopectic gypsum paste. In yet another example, the plurality of particles is a plurality of silica nanoparticles. In this example, liquid polyethylene glycol (PEG), may be added to the plurality of silica nanoparticles to form a dilatant fluid comprising a suspension of the plurality of the silica nanoparticles in the PEG.

In some embodiments, the non-Newtonian fluid precursor (e.g., the plurality of particles) may be mixed with the other types of the radiation shielding materials before the liquid is added. For example, addition of a liquid to the combination of the non-Newtonian fluid precursor and the other radiation shielding materials may form a composite shielding fill material $M_c$ having non-Newtonian properties. For instance, in a non-limiting aspect, combining at least one of: sand, cement, or any combination thereof, with at least one of: cornstarch, gypsum, or any combination thereof and then adding water to a resulting mixture, may result in a composite form of concrete having shear-thickening properties. Of course, in some embodiments, the Non-Newtonian fluid may also be formed prior to introduction of the other radiation shielding materials.

In some embodiments, the radiation shielding fill material M may include a non-Newtonian fluid that is present in a mixture with metallic or high atomic number element particles, such as tungsten, for example, which may or may not dissolve in the non-Newtonian fluid. The metallic or high atomic number element particles may be used to attenuate ionizing radiation (gamma, X-ray, and/or high ultraviolet radiation). The elements used in the mixture may be tailored to the type of radiation used.

In some embodiments or aspects, a plurality of modules may be layered together to optimize shielding. For example, a first set of modules may be connected to define the containment area, and at least a second set of modules may surround at least a portion of the first set of modules. In some embodiments or aspects, the first set of modules may define an inner layer while the at least second set of modules may define one or more outer layers. The first set of modules may be filled with a first radiation shielding fill material, while the second set of modules may be filled with a second radiation shielding material different from the first radiation shielding material or the same as the first shielding material. The plurality of sets of modules can be selected with different fill materials to optimize shielding and create a composite shielding barrier.

In some embodiments, after the use of the temporary radiotherapy facility TRV at a particular location for a period of time, the TRV may be disassembled for transport to another location. To further assist in the rapid disassembly, the non-Newtonian fluid may be pumped out of the void spaces and transported, or properly disposed. This process may remove a significant amount of mass from the TRV for to facilitate transport.

In some embodiments or aspects, after the use of the temporary radiotherapy facility TRV at a particular location for a period of time, the TRV may be disassembled for transport to another location. To further assist in the rapid disassembly, a salt (e.g., sodium chloride, potassium chloride) may be introduced into the radiation shielding fill material M with the SAP gel so as to induce a phase state transition from a SAP gel back to a SAP solid form with a separate liquid phase, such as water. This process allows for easy removal of the entire mass from the TRV to facilitate transport. In some embodiments or aspects, a cation of the salt used to transition the SAP gel into a solid form may be the same cation as is present in the SAP. For instance, if the SAP is sodium polyacrylate, the salt may be sodium chloride. Likewise, if the SAP is potassium polyacrylate, the salt may be potassium chloride.

In some embodiments or aspects, the SAP may be reduced back to a liquid state by using a salt brine typically used to melt snow and ice.

In some embodiments or aspects, the SAP may be reduced back to a liquid state by heating the SAP material to 210 Fahrenheit, such as with equipment used for melting snow.

Roof modules (not shown) may be designed so as to be placed above modules 101, 102 and 103 and to have trusses spanning from a shear wall 64 in module 101 to a shear wall 62 in module 103. Similarly, roof modules may be configured to support the radiation shielding fill material M over the treatment room 20 in voids formed within the roof modules so also allow introduction of the radiation shielding fill material M. As a result, the load of the radiation shielding fill material directly above the treatment room 20 may be distributed through the trusses to the shear walls 62, 64 rather than bearing on the treatment room itself.

The foundation for the facility may be a simple concrete slab. The effects of sinking and/or seismic activities for a radiotherapy structure on a concrete slab may result in a leakage of radioactivity. Moreover, a concrete slab is a more permanent structure and may not be useful for a temporary structure such as a TRV. In some embodiments or aspects, a pattern of recessed grade beams as a foundation for temporary structures may be used for easier assembly and better weight distribution.

Figure 2:
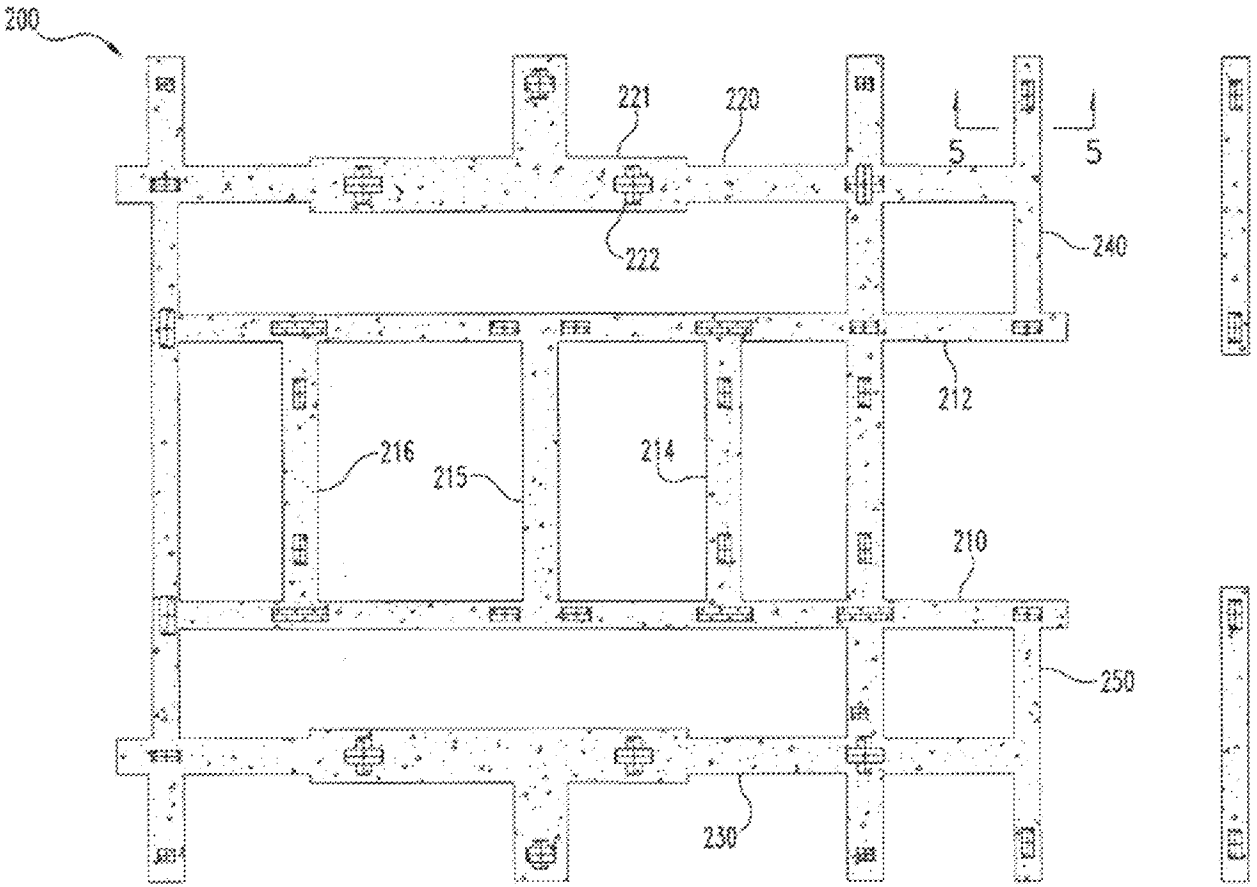
FIG. 2 is a top plan view layout of a foundation of the first exemplary modular facility, in accordance with one or more embodiments or aspects of the present disclosure.

FIG. 2 is a top plan view layout of a foundation 200 of the first exemplary modular facility, in accordance with one or more embodiments or aspects of the present disclosure. Foundation 200 may include a pattern of elongated beams of reinforced concrete, for example. Individual beams of reinforced concrete may also be referred to as grade beams, since they are typically constructed at or above grade level. The grade beams for the foundation are recessed several inches below-grade (e.g. 3-6 inches). The use of below-grade, grade beams makes it easier to return the site to its original condition once the facility such as a TRV has been removed, since one could simply backfill over the below-grade, grade beams.

The pattern of elongated beams may include a number of parallel and orthogonal beams and beam segments. These beams may underlie various portions of facility 10. The layout of foundation 200 in FIG. 2 corresponds to the floor plan of facility 10 of FIG. 1. Parallel beams 210 and 212 may underlie the elongated sides of module 102 and short transverse beams 214, 215 and 216 span between beams 210 and 212 at multiple locations along the lengths of beams 210 and 212. These short transverse beams 214, 215, 216 serve to provide a degree of integration or coupling between beams 210 and 212, and they also serve to underlie and provide support module 102 in which the radiotherapy device 25 is located and mounted. Beams 220 and 230 are designed to underlie and provide support to the shear walls 62 and 64 in modules 103 and 101 respectively. Because this is a large mass of material, it provides significant inertial resistance to any lateral movement that would develop during a seismic event (i.e., an earthquake).

In some embodiments, the facility may be supported directly on the ground surface, or on plates, such as steel plates, laid on the ground surface. In this manner, the existing ground surface would not have to be disturbed by installing a foundation. In further embodiments or aspects, the facility may be supported by one or more helical or screw piles that are driven into the ground. The facility may be supported on an upper end of the helical or screw piles that may be protrude from the ground surface. In this manner, surface disruption can be limited and does not require the use of concrete. The helical or screw piles may be removed from the ground after the temporary facility is removed.

Figure 3:
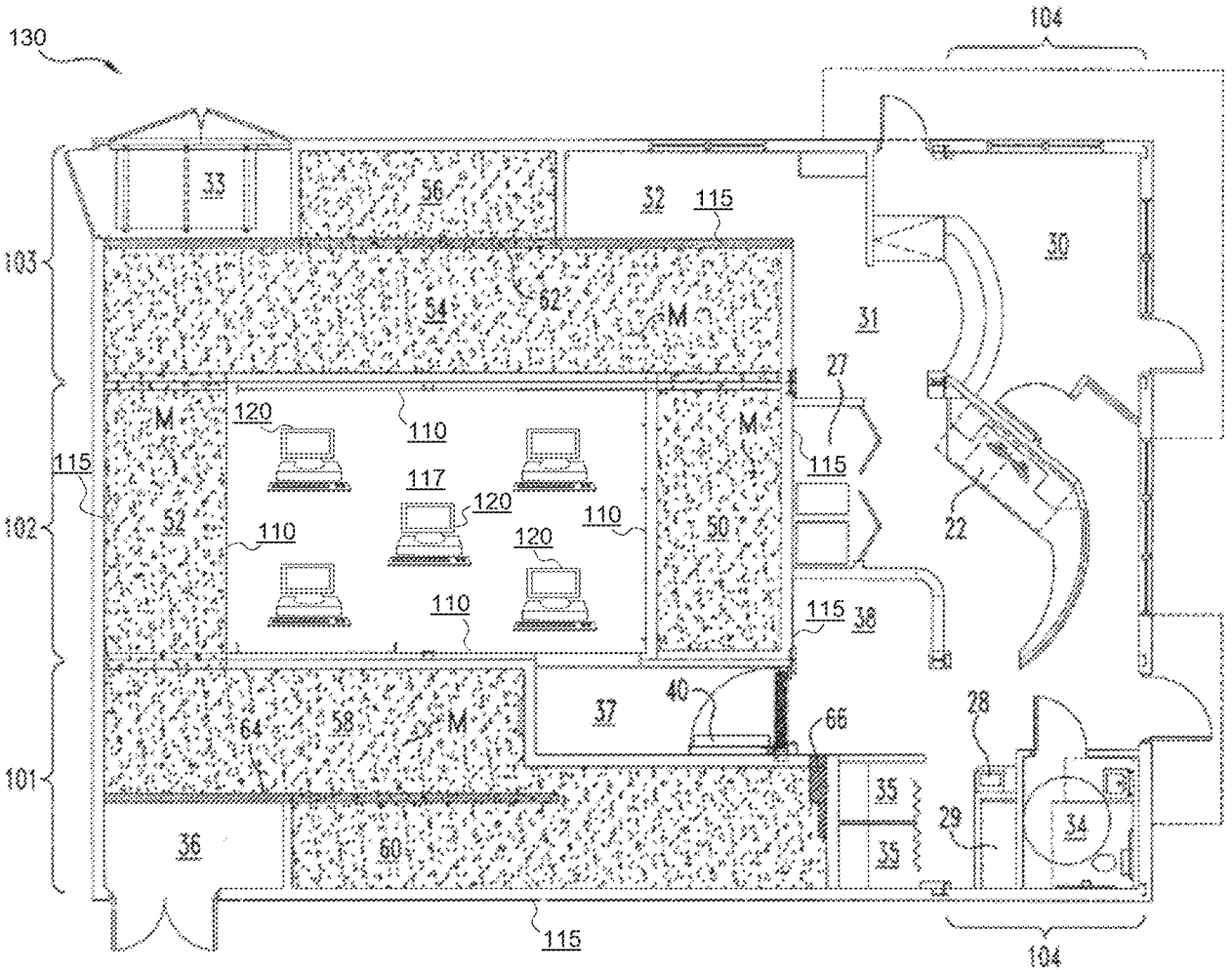
FIG. 3 is a floor plan of another modular facility for the radiation shielding of a plurality of electronic devices, in accordance with one or more embodiments or aspects of the present disclosure.

FIG. 3 is a floor plan of another modular facility 130 for the radiation shielding of a plurality of electronic devices, in accordance with one or more embodiments or aspects of the present disclosure. In the same manner that the radiation shielding fill material M may be chosen to keep radiation from radiotherapy device 25 from leaking out of treatment room 20 in FIG. 1, radiation shielding fill material M may be chosen to keep radiation outside of facility 130 from entering an inner chamber 117 with a plurality of electronic devices 120. In the embodiments or aspects shown in FIG. 3, facility 130 is identical to facility 10 except that inner chamber 117 in FIG. 3 is in place of treatment room 20 of FIG. 2. Facility 117 may also use the same foundation (e.g., foundation 200) of FIG. 2.

In the event of high intensity electromagnetic fields, such as an electromagnetic pulse generated from a nuclear-bomb, for example, incident on any of the plurality of electronic devices 120 may inductively create high currents in the electronic circuitry of electronic devices 120, causing their failure. Thus, facility 130 may be designed as a Faraday cage to shield electronic devices 120 in inner chamber 117 from the electromagnetic pulses external to facility 130. Radiation shielding fill material M may include metals for electromagnetic shielding such as Mn—Zn, Al, Cu, Fe—Si, steel 410, and/or Fe—Ni, for example. These may be introduced as sheets, particles, particles in colloidal suspensions for activating SAP materials in void spaces 50, 52, 54, 56, 58, and 60 as shown in FIG. 3. SAP materials may be used to hold these metals for electromagnetic shielding. In some embodiments or aspects, addition of the SAP materials may allow for less of the metals to be used in electromagnetic shielding, thereby providing material and cost savings.

Figure 4:
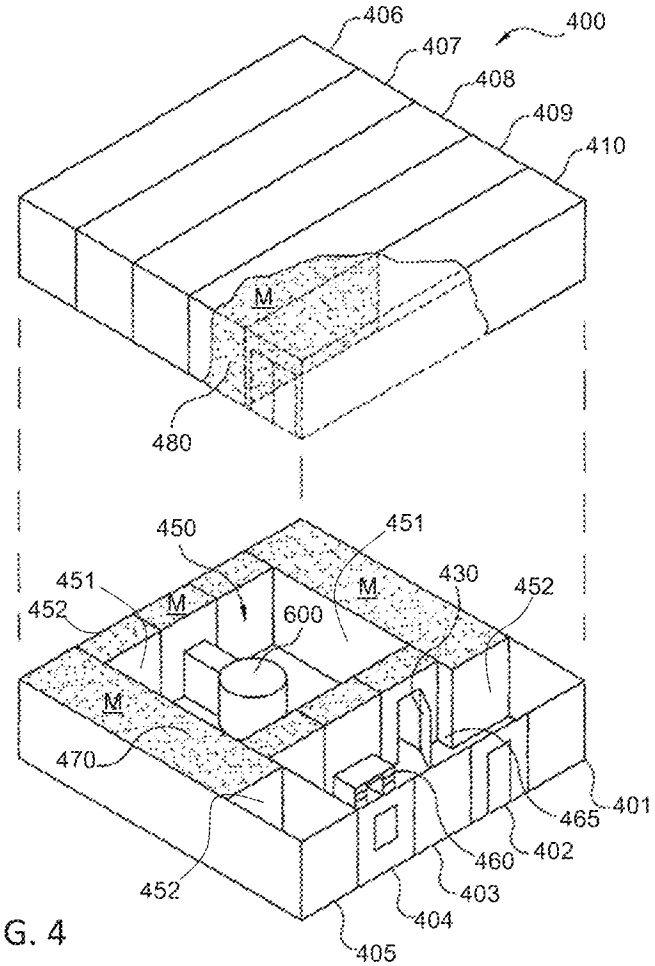
FIG. 4 is an isometric exploded view of a second exemplary modular facility, in accordance with one or more embodiments or aspects of the present disclosure.

FIG. 4 is an isometric exploded view of a second exemplary modular facility 400, in accordance with one or more embodiments or aspects of the present disclosure. Radiotherapy facility 400 for housing therapeutic radiation equipment is depicted. Radiotherapy facility 400 may be a temporary modular facility that is assembled to form a radiation therapy vault room 450. Radiotherapy facility 400 may be delivered to an assembly site in sections with all equipment and finishing in place. The individual sections 401-410, herein referred to as pods, modules, or free standing transportable modules, are each capable of being shipped by rail, ship, or overland freight and being assembled together using commonly available equipment such as cranes or container movers.

In some embodiments or aspects, radiotherapy facility structure 400 may include, for example, a total of ten pods, and may have two or more interior rooms. One room 450 may be adapted to contain equipment capable of being used to perform radiation therapy, and the other room 460 may be adapted to be used as a control area suitable for use by a radiation therapist or technician operating the equipment contained in room 450.

In some embodiments or aspects, radiotherapy facility structure 400 may include a series of interior and adjoining containers that can be filled with radiation shielding material to form a radiation barrier 470 around treatment area 450 and a roof radiation barrier 480 above treatment area 450. The radiation shielding fill material M may be a solid form of SAP mixed with a liquid such as water to form a flowable SAP gel. The radiation shielding fill material M may include other materials such as metal sheets, concrete or cement slabs, and/or granular material such as sand. In other embodiments or aspects, the SAP gel may hold and/or physically support the other materials used in the radiation shield.

In some embodiments, radiotherapy facility structure 400 may include a series of interior and adjoining containers that can be filled with radiation shielding material to form a radiation barrier 470 around treatment area 450 and a roof radiation barrier 480 above treatment area 450. The radiation shielding fill material M may include a non-Newtonian fluid. The radiation shielding fill material M may include other materials such as metal sheets, concrete or cement slabs, and/or granular material such as sand. In other embodiments, the non-Newtonian fluid material may hold and/or physically support the other materials used in the radiation shield.

Five pods (pods 401-405 referred to as the footprint pods) may be used to form the footprint of radiotherapy facility structure 400. An additional five pods, (pods 406-410, referred to as the roof pods) may be placed on top of and perpendicular to the five footprint pods. Of the five roof pods, four pods (pods 406-409, referred to as the "roof shielding pods") may provide additional radiation shielding in the vertical direction by way of the roof barrier 480, whereas pod 410 may be used primarily as a storage area.

Pods 402, 403, and 404 may be connected together to form the interior workspace or therapy room 450. In this second exemplary embodiment, pod 403 serves as the center footprint pod, containing most of the medical equipment, and may include electrical connections for electrical power and a mounting platform for the medical equipment 600. A weather seal may be incorporated along the joints between all of the footprint pods as well.

Pod 401 may be attached to the exterior side of pod 402, and pod 405 may be attached to the exterior side of pod 404. These two pods (pod 401 and pod 405), together with portions of pods 402-404, may receive the radiation shielding fill material to form radiation barrier 470. Radiation barrier 470 may extend substantially around all sides of the room 450, with pod 402 including a doorway to permit access to the treatment room 450. The roof shielding pods (pods 406-409) may be placed above and connected to the five footprint pods, at least pods 401 and 405 including roof support structures 420, 422 to support the load of the roof pods. Pods 406-409 may be used for radiation shielding purposes whereas pod 410 can be reserved to house the electrical equipment, telephone equipment and other utilities.

For assembly, a suitable foundation, such as a concrete slab, or foundation 200 with a pattern of elongated beams of reinforced concrete as in FIG. 2, may be first fabricated. The foundation is then leveled and the first of the footprint pods, for example pod 403, may be placed on and anchored to the foundation. The remaining footprint pods may then be sequentially placed and attached to their respective adjoining pod(s) and to the foundation. A weather seal may be formed between adjoining pods and the foundation.

In some embodiments or aspects, radiation shielding fill material may then be pumped into the containers of the various footprint pods to form barrier 470. In some embodiments or aspects, the radiation shielding fill material may include SAP solid material, for example, which may be introduced into the containers of the various footprint pods, and transformed into a gel or sol using water and/or a colloidal mixture which may include radiation absorbing metals. In some embodiments or aspects, the radiation shielding fill material may include the non-Newtonian fluid material, for example, which may be introduced into the containers of the various footprint pods, which may include radiation absorbing metals.

In some embodiments or aspects, barrier 470 surrounding central treatment area 450 may include first 451 and second 452 spaced-apart-walls and a quantity of radiation shielding fill material M contained between the first 451 and second 452 spaced-apart-walls. In some embodiments or aspects, the radiation shielding fill material M may include a super-absorbent polymer (SAP). In some embodiments or aspects, the radiation shielding fill material M may include the non-Newtonian fluid. At least two of the free standing transportable modules 401-410 each include portions of the first 451 and second 452 spaced-apart-walls that are rigid. The portions may define a channel 452 including a portion of barrier 470. The quantity of radiation shielding fill material M (disposed in channel 452) may be sufficient to substantially reduce the measurable radiation level outside central treatment area 450 (e.g., in room 460) when a radiation source 600 is placed in central treatment area 450.

Either before or after filling the containers of the various footprint pods with the radiation shielding fill material, the roof pods may be placed on and attached to the five footprint pods. A weather seal may then be formed between the footprint pods and the roof pods as well as between adjoining roof pods. Radiotherapy facility structure 400 may then be filled with the radiation shielding fill material as needed for the proper radiation shielding. Electrical, water and sewage may then be connected to the modular facility. In implementing radiotherapy facility structure 400 as a modular facility, the assembly time from the time of the pods' arrival-on-site to finishing the fully-assembled, radiotherapy facility structure 400 may be minimized.

Figure 5:
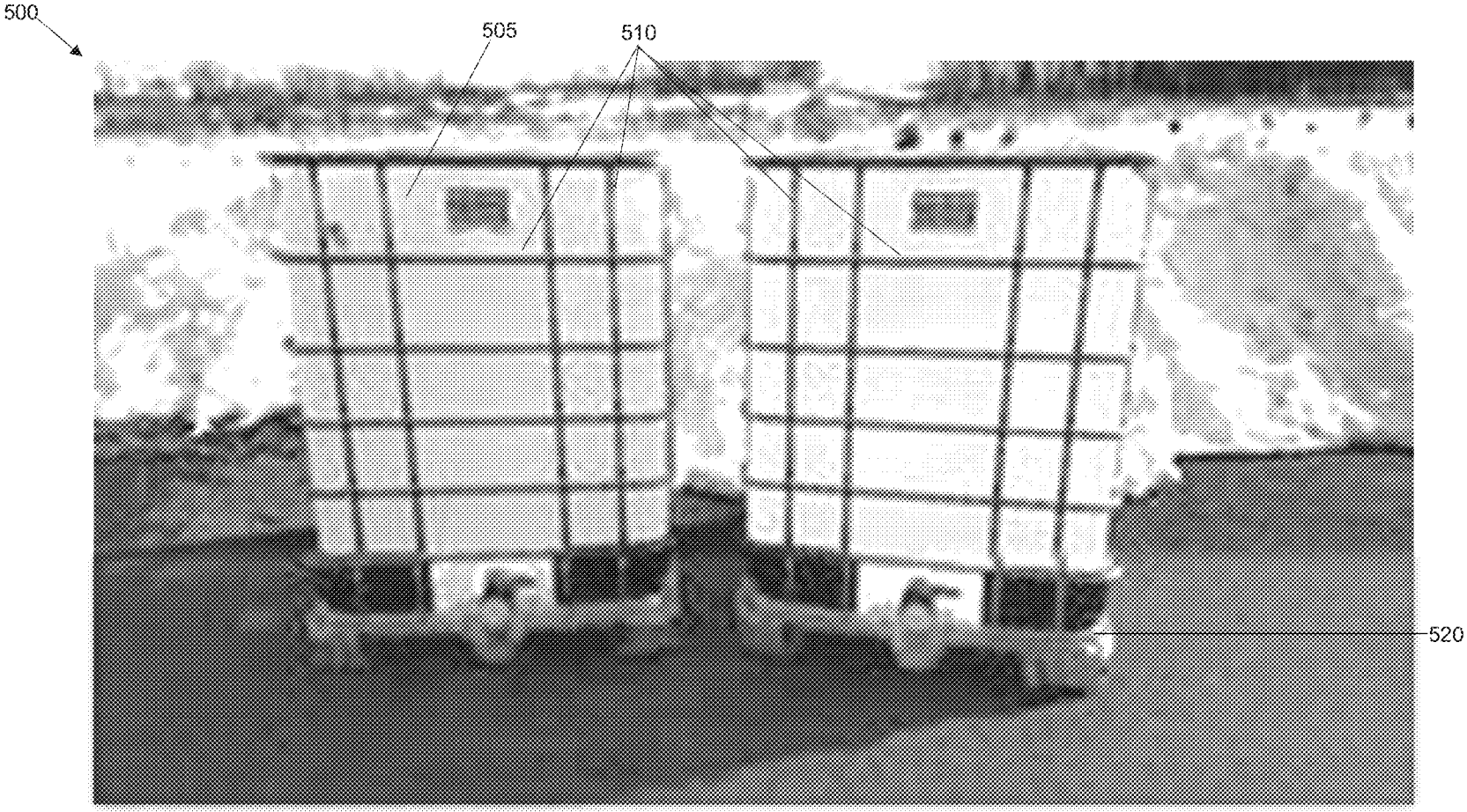
FIG. 5 illustrates an airoof X-pod facility, in accordance with one or more embodiments or aspects of the present disclosure.

FIG. 5 illustrates an airoof X-pod temporary facility 500, in accordance with one or more embodiments or aspects of the present disclosure. Temporary facility 500 may be formed from fabrics 505 held in place by structural bracing 510. Temporary facility 500 may be placed on a trailer 520. SAP expanding gel may be pumped into fill the voids, with fabrics 505 forming flexible walls that may expand outward. In some embodiments or aspects, there may be SAP tubes for the temporary facility 500 sitting on trailer 520. In other embodiments or aspects, vertical tubes, or sonotubes, may be used for concrete forms.

In some embodiments or aspects, a non-Newtonian fluid may form a composite with the fabrics 505. For instance, the non-Newtonian fluid may be impregnated in into spaces between aramid-fibers in a polyaramid fabric material so as to form a shear-thickening fabric composite. A suitable example of a shear-thickening fabric composite is described in US Patent Application Publication 2005/0266748, which is incorporated by reference herein in its entirety. In some embodiments, there may be tubes for the non-Newtonian fluid material for the temporary facility 500 sitting on trailer 520. In other embodiments, vertical tubes, or sonotubes, may be used for concrete forms.

In some embodiments or aspects, airoof X-pod temporary facility 500 may be placed on composite plates foundation (similar to FIG. 2) so as to avoid the need for a concrete foundation. In this manner, composite plates may spread the weight load of temporary facility 500. Helical piles may be used with plates and/or beams.

In the embodiment shown in FIG. 5, only 4-8 tons of SAP radiation shielding fill material, for example, may be needed and shipped to the assembly location. The SAP radiation shielding fill material may be introduced via the SAP tubes into the voids (similarly to void spaces 50, 52, 54, 56, 58, and 60 around the treatment room 20 as in FIG. 1). A liquid, such as water, may be pumped into the structure to convert the SAP solid to gel. The gel may allow fabrics 505 to expand as the void spaces are filled where the SAP radiation shielding fill material is needed. In some embodiments or aspects, the gel may yield 600 times more mass than the original 4-8 tons of SAP solid material providing large savings in shipping costs. Such radiation shielding may be optimal for neutron radiation (e.g., at 6 MeV).

In some embodiments or aspects, when airoof X-pod temporary facility 500 is to be disassembled, salts (e.g., sodium) may be introduced into the SAP gel initiating a SAP phase transition from gel to solid. The water (if not radioactive) may be pumped down the drain and the lighter-weight airoof X-pod temporary facility 500 without the weight of the liquid may be transported for assembly at a different location.

In the embodiment shown in FIG. 5, although the non-Newtonian fluid and/or non-Newtonian fluid precursor may need to be shipped to the assembly site for assembling airoof X-pod temporary facility 500, the non-Newtonian fluid may be pumped out and transported. The lighter-weight airoof X-pod temporary facility 500 may be transported without the weight of the non-Newtonian fluid for assembly at a different location. In some embodiments, the non-Newtonian fluid may be converted back to the non-Newtonian fluid precursor, and shipped to the next assembly site. This may be particularly beneficial in reducing shipping costs if the non-Newtonian Newtonian fluid precursor has a lighter weight than the non-Newtonian fluid, or may be less toxic, for example.

Figure 6:
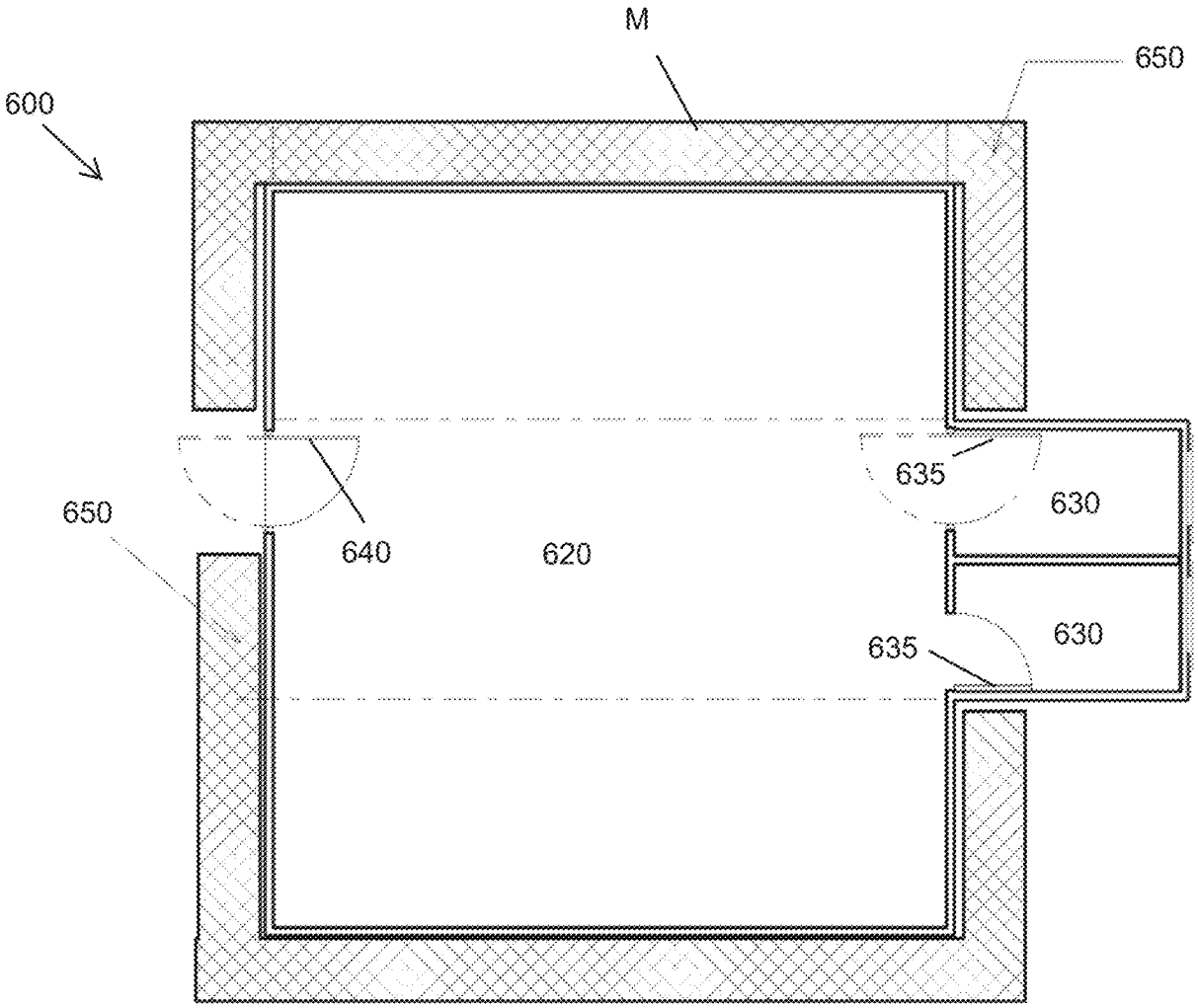
FIG. 6 is a floor plan of another modular facility in accordance with one or more embodiments or aspects of the present disclosure.

FIG. 6 is a floor plan of another exemplary modular facility 600 in accordance with one or more embodiments or aspects of the present disclosure. The facility 600 may include a shielded containment area 620 and one or more auxiliary containment areas 630. In some embodiments or aspects, the one or more auxiliary containment areas 630 may be separable from the shielded containment area 620 by a door 635. Access to containment area 620 may be via a radiation shielded door 640. The features of the floor plan of facility 600 as shown in the embodiments or aspects of FIG. 6 may be a permanent and/or a temporary radiotherapy building structure, a permanent and/or a temporary electromagnetic radiation shielding structure, a permanent and/or a temporary ballistic or blast shielding structure, or any combination thereof. Facility 600 may also use the same foundation (e.g., foundation 200) of FIG. 2.

Figure 7:
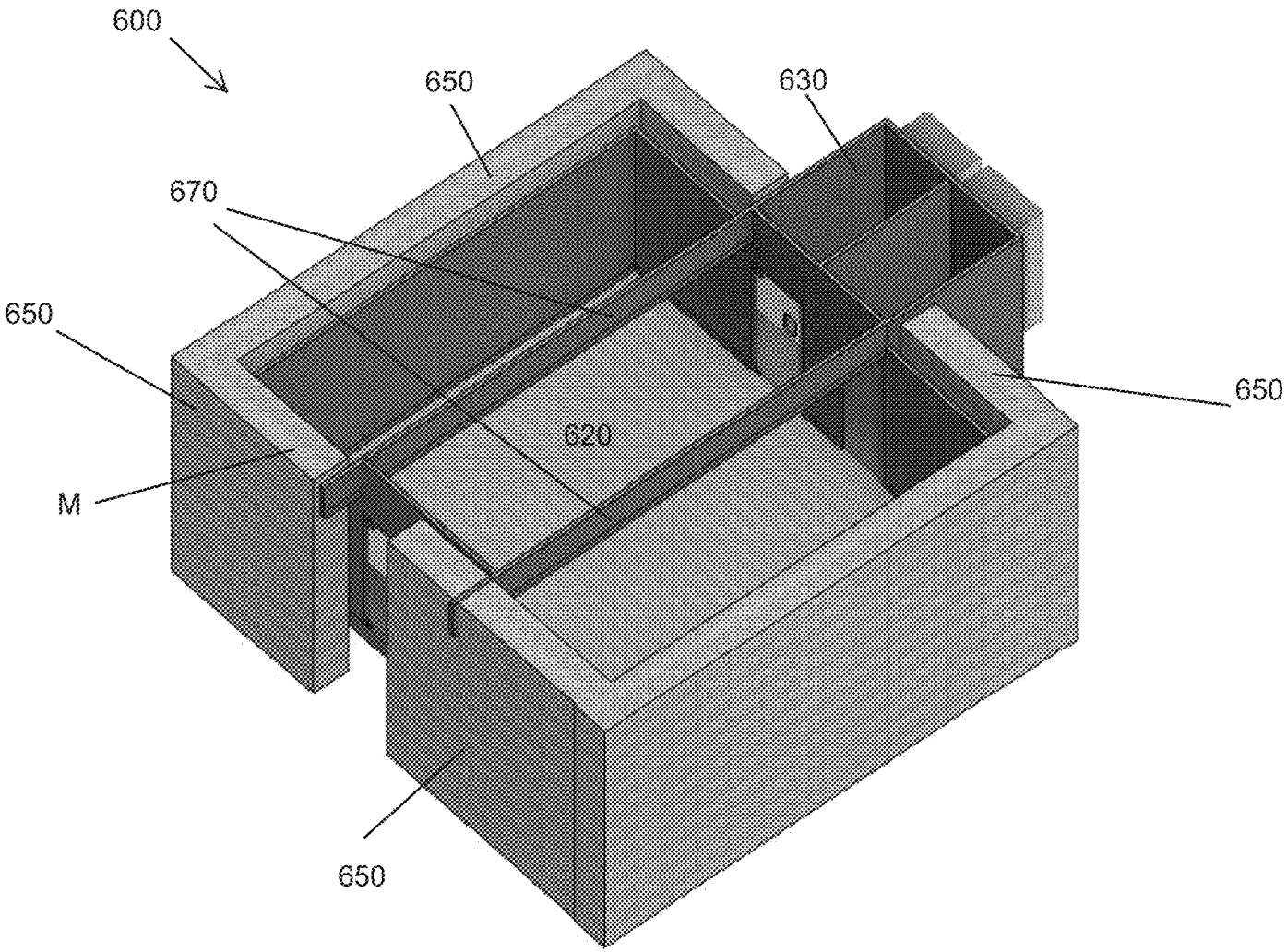
FIG. 7 is an isometric view of the modular facility shown in FIG. 6.

With reference to FIG. 7, the modular facility 600 may be constructed from a plurality of modules, such as a plurality of sidewall modules 650 that define the vertical walls of the modular facility 600. In some embodiments or aspects, one or more roof modules may be added on top of the modules 650, and one or more floor modules may be added to the bottom of the modules 650 to fully enclose the containment area 620. As shown in FIG. 7, one or more trusses 670 may span between the opposing sidewall modules 650 to provide support for the one or more roof modules.

In some embodiments or aspects, modules 650 may be designed such that, when assembled, the assembled modules define a number of void spaces between first and second walls of each individual module 650. These void spaces may be designed to be filled with a radiation shielding fill material M, such as the SAP and/or the non-Newtonian fluid described herein. In some embodiments or aspects, the radiation shielding fill material M may include SAP and/or a non-Newtonian fluid along with any suitable type of radiation shielding fill material, such as metal sheets, granular fill, sand, cement, concrete, and the like, that may be introduced into the voids. The radiation shielding fill material M may be chosen to keep radiation from a radiotherapy device from leaking out of the containment area 620, or to keep radiation outside of facility 600 from entering the containment area 620. While FIGS. 6-7 are directed to a modular facility 600, in other embodiments or aspects, the facility 600 may be an existing structure wherein additional walls or panels are provided to impart radiation, ballistic, and/or blast properties to an existing structure.

Figure 8:
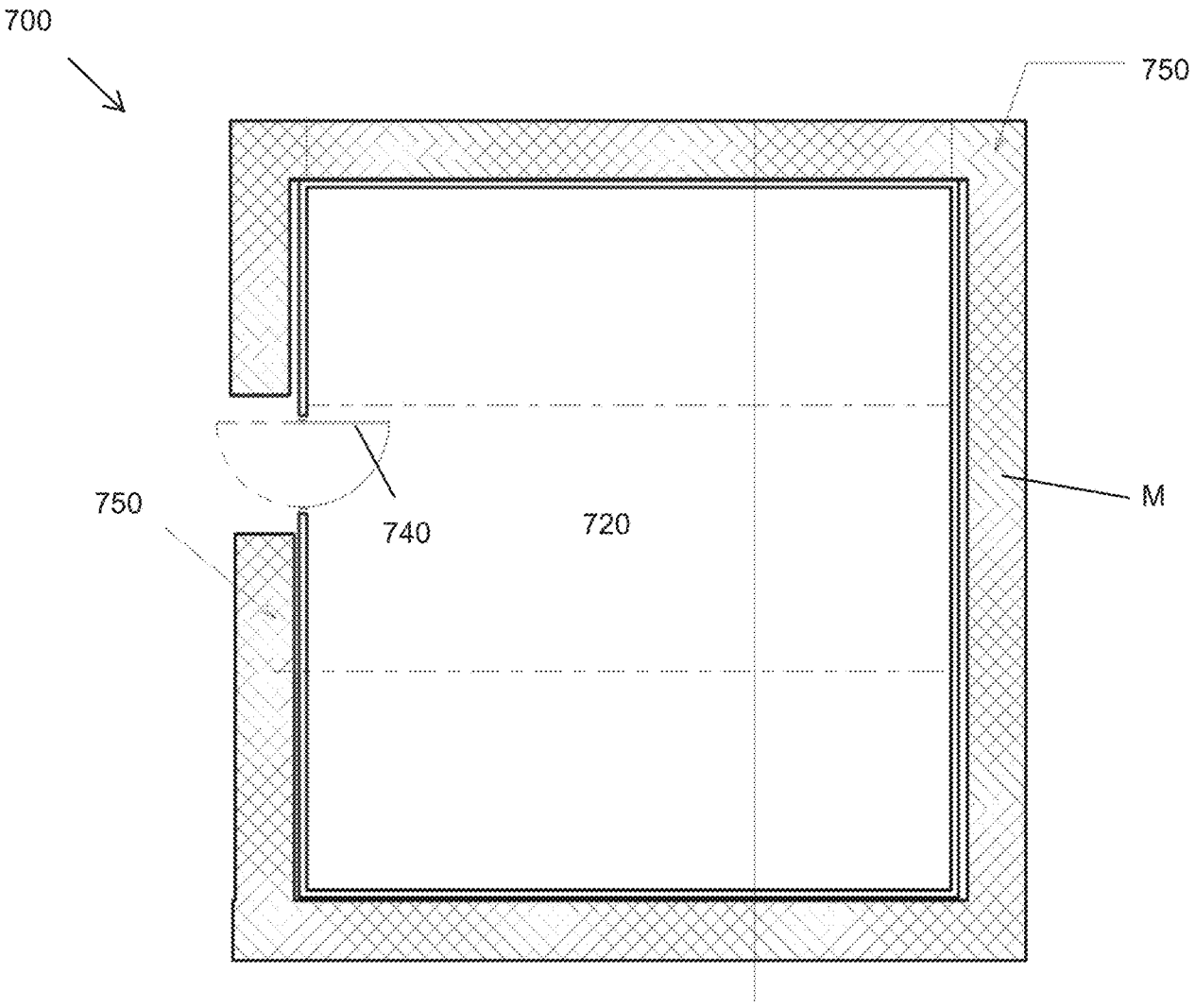
FIG. 8 is a floor plan of another modular facility in accordance with one or more embodiments or aspects of the present disclosure.

FIG. 8 is a floor plan of another modular facility 700 for the radiation shielding of a plurality of electronic devices, in accordance with one or more embodiments or aspects of the present disclosure. The facility 700 may include a shielded containment area 720. Access to containment area 720 may be via a radiation shielded door 740. The features of the floor plan of facility 700 as shown in the embodiments or aspects of FIG. 8 may be a permanent and/or a temporary radiotherapy building structure, a permanent and/or a temporary electromagnetic radiation shielding structure, a permanent and/or a temporary ballistic or blast shielding structure, or any combination thereof. Facility 700 may also use the same foundation (e.g., foundation 200) of FIG. 2.

Figure 9:
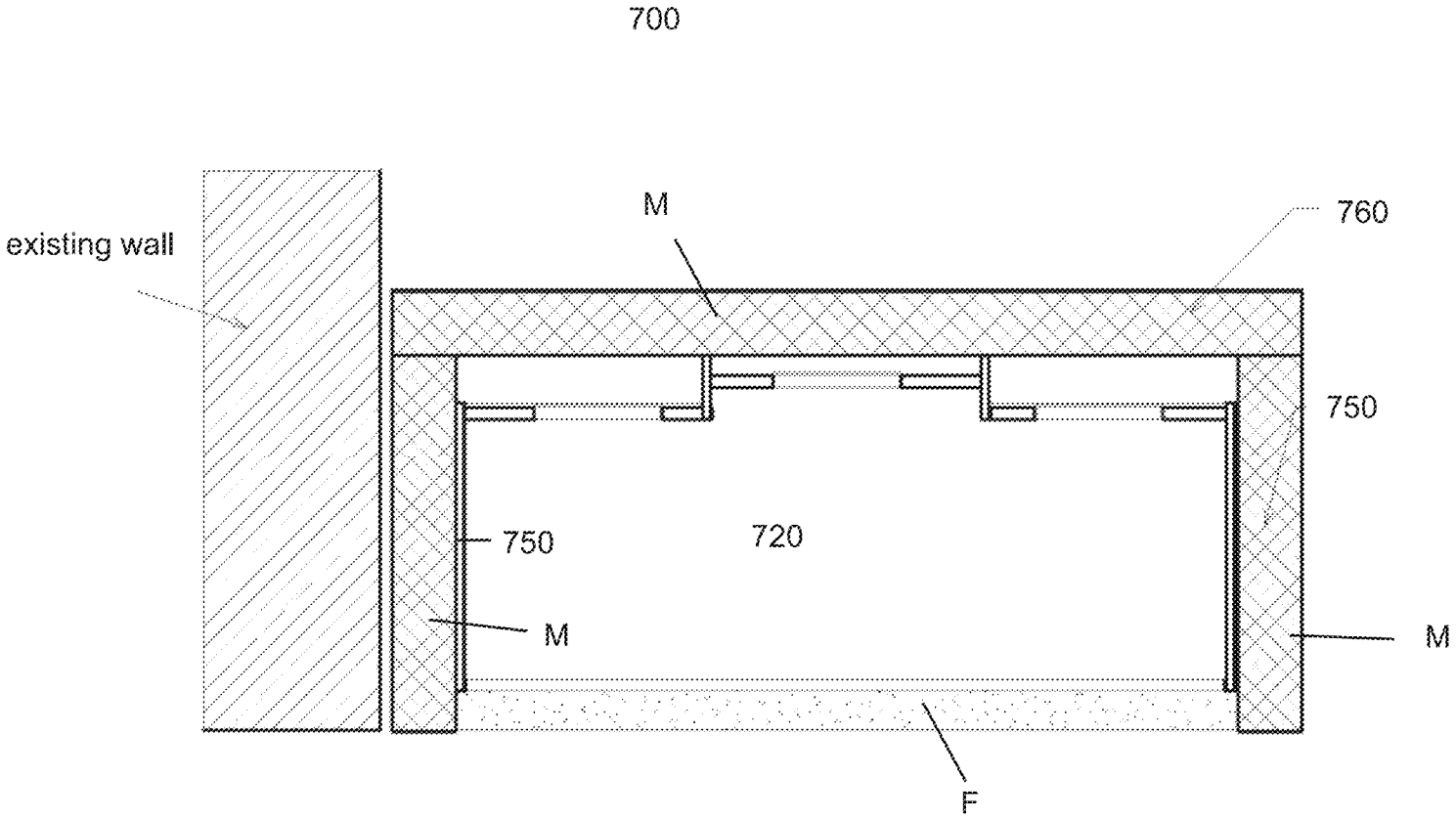
FIG. 9 is a side view of the modular facility shown in FIG. 8.
Figure 10:
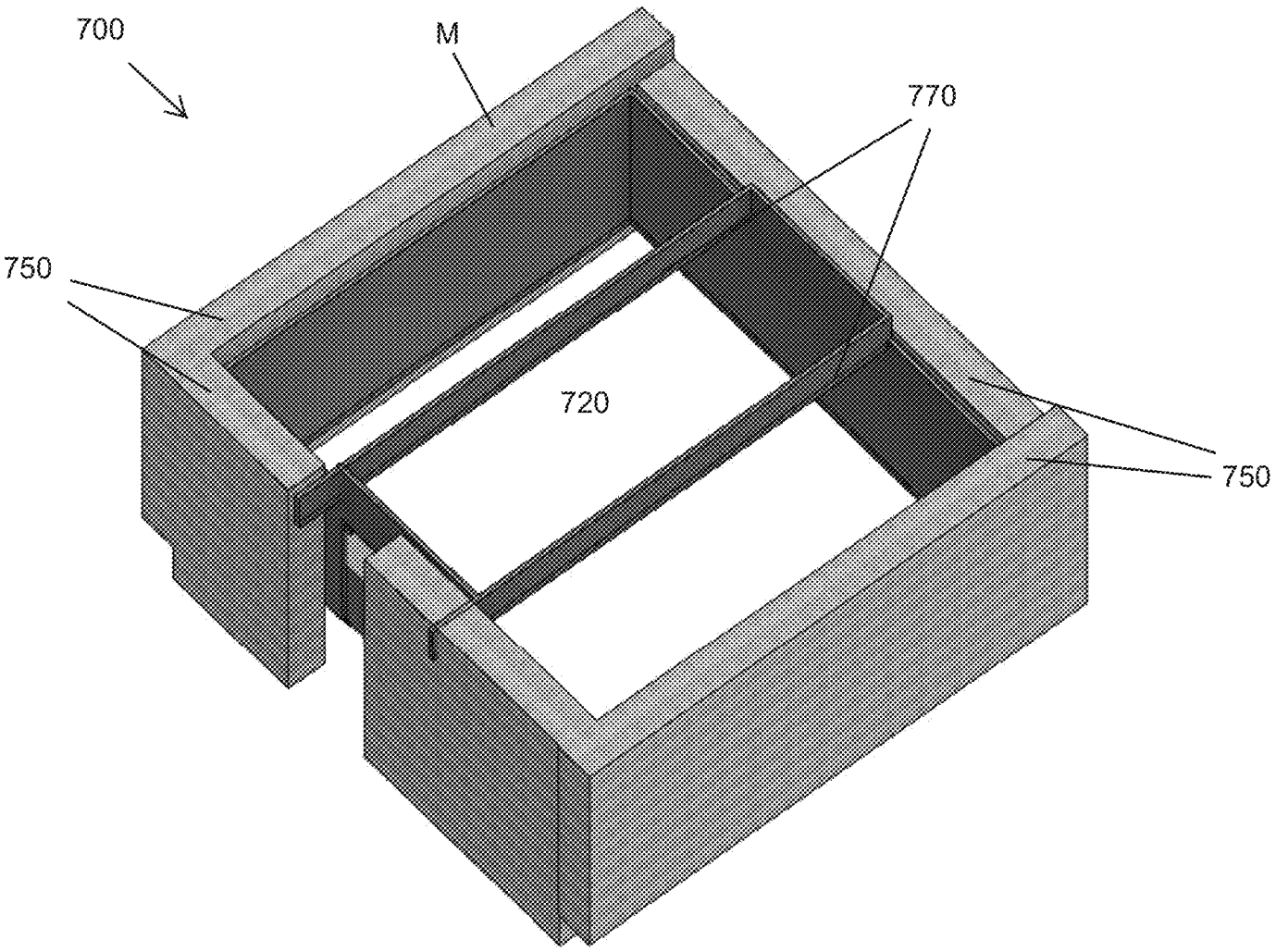
FIG. 10 is an isometric exploded view of the modular facility shown in FIG. 8.

With reference to FIGS. 8 and 9, the modular facility 700 may be constructed from a plurality of modules, such as a plurality of sidewall modules 750 that define the vertical walls of the modular facility 700. In some embodiments or aspects, one or more roof modules 760 may be added on top of the sidewall modules 750. The floor may be defined by an existing concrete floor F or by one or more floor modules connected to the bottom of the sidewall modules. In some embodiments or aspects, the roof and sidewall modules may be designed such that, when assembled, the assembled modules define a number of void spaces between first and second walls of each individual module. These void spaces may be designed to be filled with a radiation shielding fill material M, such as the SAP and/or the non-Newtonian fluid described herein. In some embodiments or aspects, the radiation shielding fill material M may include SAP and/or a non-Newtonian fluid along with any suitable type of radiation shielding fill material, such as metal sheets, granular fill, sand, cement, concrete, and the like, that may be introduced into the voids. The radiation shielding fill material M may be chosen to keep radiation from a radiotherapy device from leaking out of the containment area 720, or to keep radiation outside of facility 600 from entering the containment area 720. As shown in FIG. 10, one or more trusses 770 may span between the opposing sidewall modules 750 to provide support for the one or more roof modules 760 (shown in FIG. 9). While FIGS. 8-10 are directed to a modular facility 700, in other embodiments or aspects, the facility 700 may be an existing structure wherein additional walls or panels are provided to impart radiation, ballistic, and/or blast properties to an existing structure.

Figure 11:
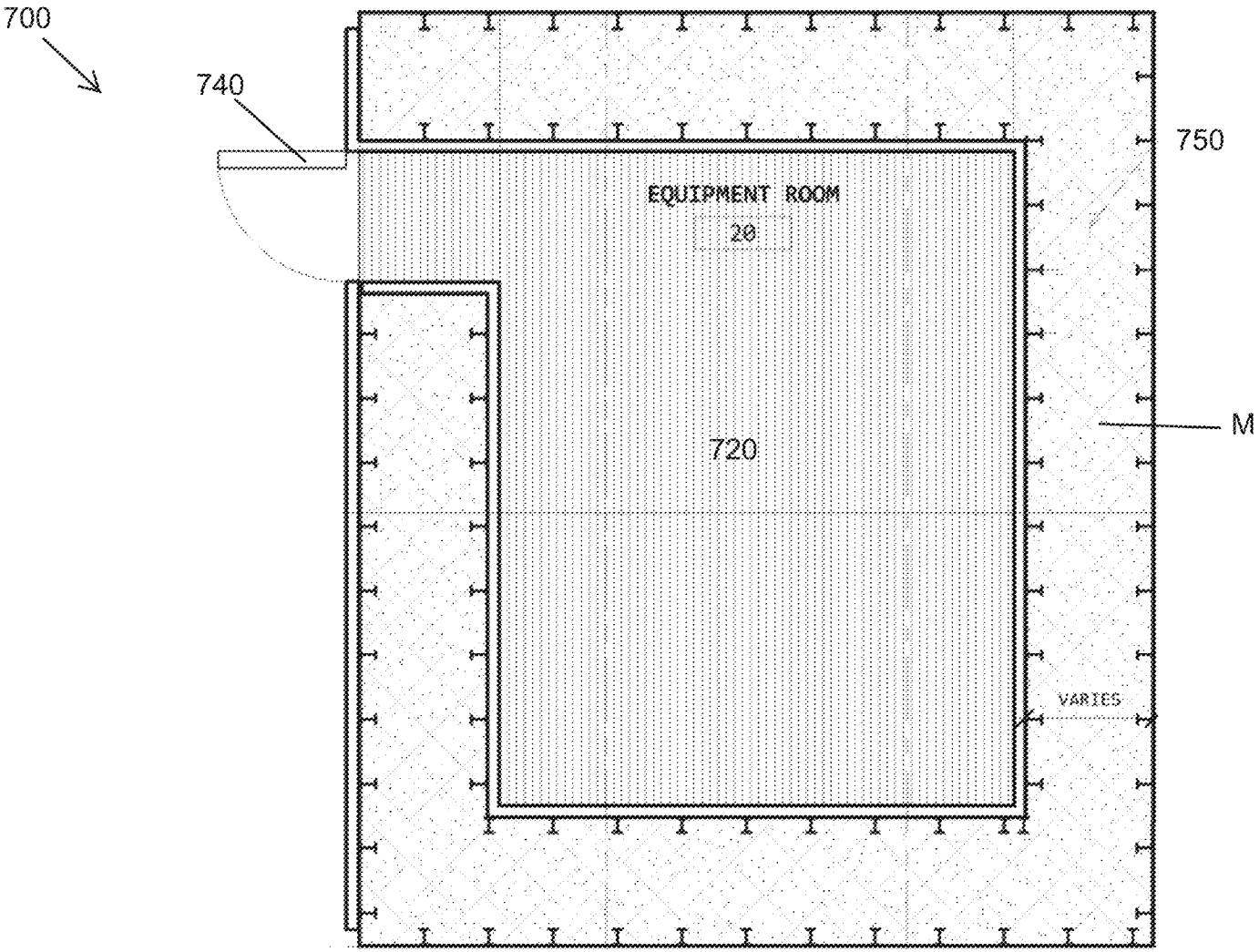
FIG. 11 is a floor plan of another modular facility in accordance with one or more embodiments or aspects of the present disclosure.
Figure 12:
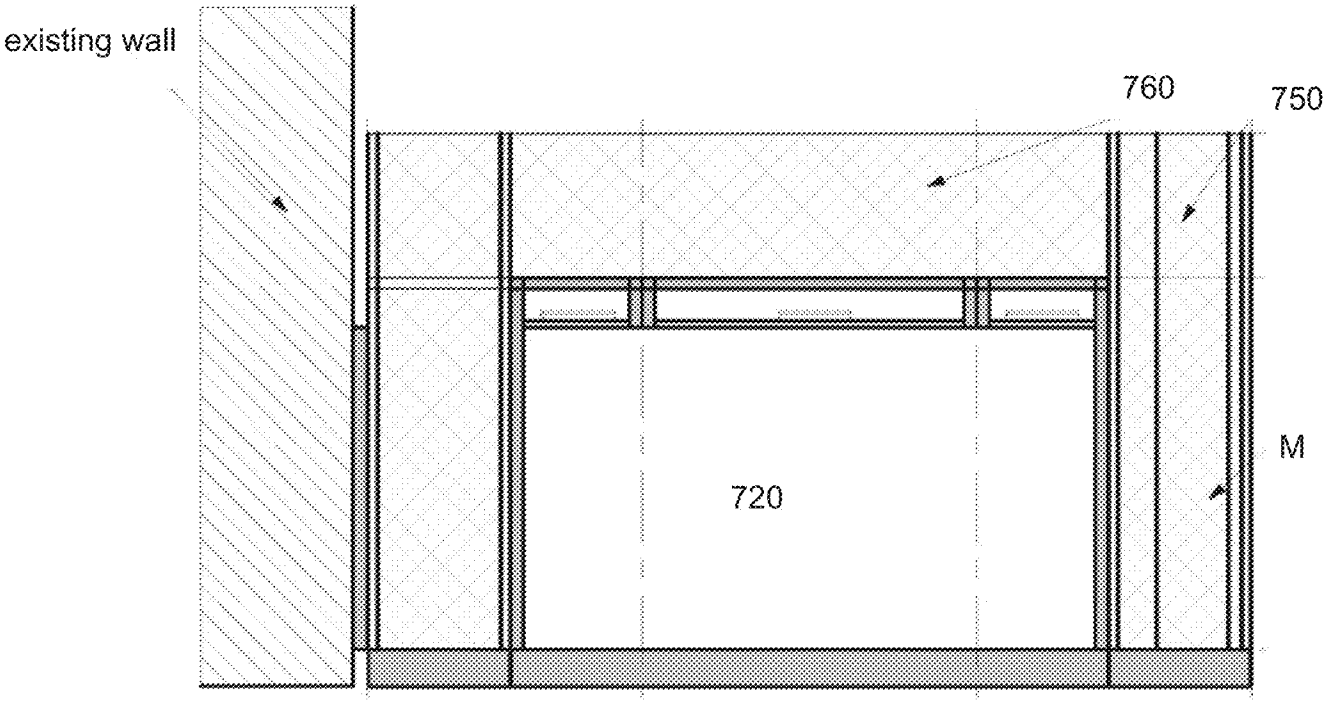
FIG. 12 is a side view of the modular facility shown in FIG. 11.

FIGS. 8 and 11 show floor plans of another modular facility 700 for the radiation shielding of a plurality of electronic devices, in accordance with one or more embodiments or aspects of the present disclosure. The facility 700 may include a shielded containment area 720. Access to containment area 720 may be via a radiation shielded door 740. The features of the floor plan of facility 700 as shown in the embodiments or aspects of FIGS. 8 and 11 may be a permanent and/or a temporary radiotherapy building structure, a permanent and/or a temporary electromagnetic radiation shielding structure, a permanent and/or a temporary ballistic or blast shielding structure, or any combination thereof. Facility 700 may also use the same foundation (e.g., foundation 200) of FIG. 2.

Figure 13:
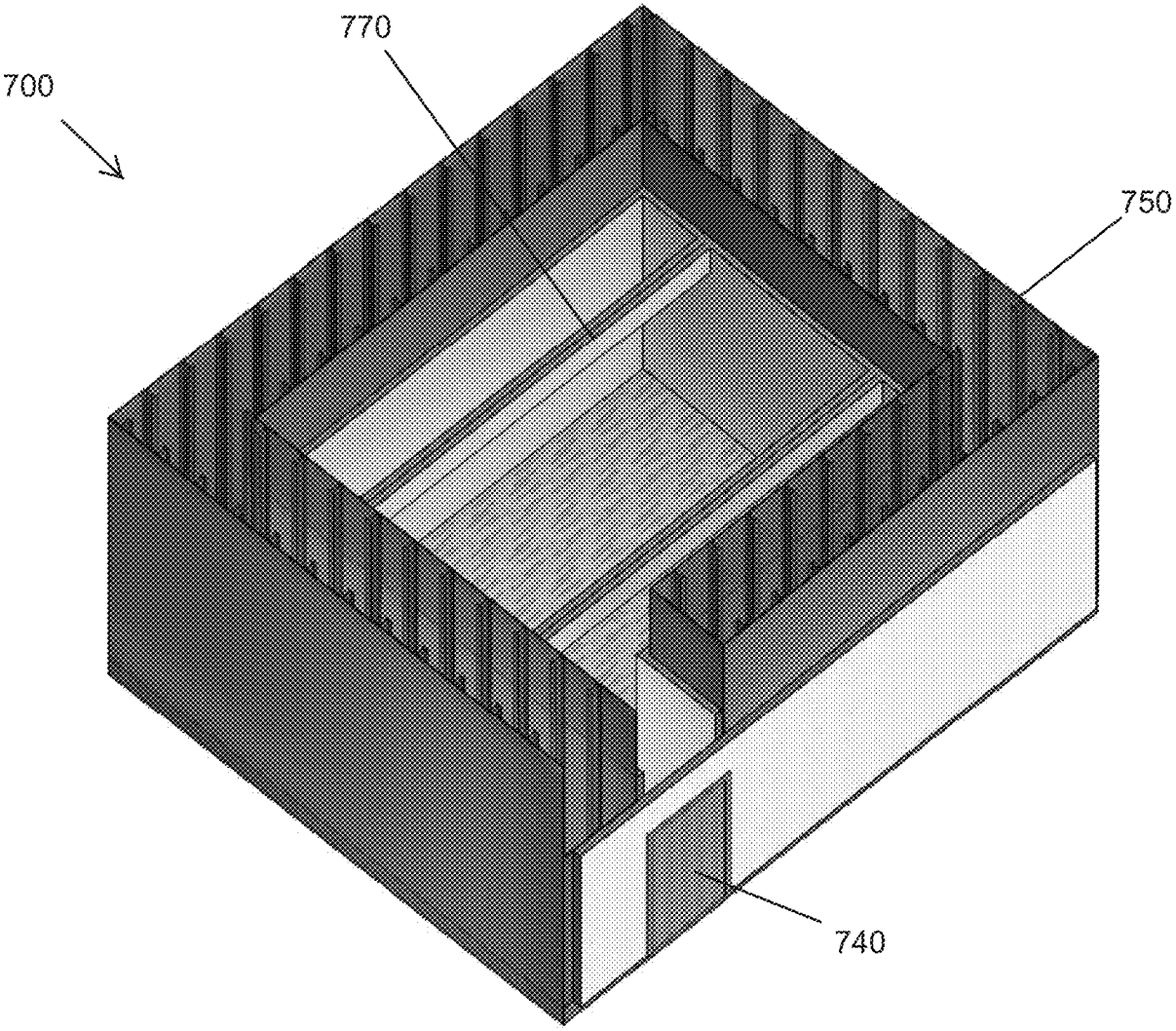
FIG. 13 is an isometric exploded view of the modular facility shown in FIG. 11.

With reference to FIGS. 8-9 and 11-12, the modular facility 700 may be constructed from a plurality of modules, such as a plurality of sidewall modules 750 that define the vertical walls of the modular facility 700. In some embodiments or aspects, one or more roof modules 760 may be added on top of the sidewall modules 750. The floor may be defined by an existing concrete floor F or by one or more floor modules connected to the bottom of the sidewall modules. In some embodiments or aspects, the roof and sidewall modules may be designed such that, when assembled, the assembled modules define a number of void spaces between first and second walls of each individual module. These void spaces may be designed to be filled with a radiation shielding fill material M, such as the SAP and/or the non-Newtonian fluid described herein. In some embodiments or aspects, the radiation shielding fill material M may include SAP and/or a non-Newtonian fluid along with any suitable type of radiation shielding fill material, such as metal sheets, granular fill, sand, cement, concrete, and the like, that may be introduced into the voids. The radiation shielding fill material M may be chosen to keep radiation from a radiotherapy device from leaking out of the containment area 720, or to keep radiation outside of facility 600 from entering the containment area 720. As shown in FIGS. 9 and 13, one or more trusses 770 may span between the opposing sidewall modules 650 to provide support for the one or more roof modules 760 (shown in FIG. 9). While FIGS. 8-13 are directed to a modular facility 700, in other embodiments or aspects, the facility 700 may be an existing structure wherein additional walls or panels are provided to impart radiation, ballistic, and/or blast properties to an existing structure.

In some non-limiting embodiments or aspects, an exemplary shielding material can include first SAP(s) that can absorb a weight amount of liquid(s) that is at least 10 times of the initial weight of the first SAP(s). In some non-limiting embodiments or aspects, an exemplary shielding material can include second SAP(s) that can absorb a weight amount of liquid(s) that is at least 100 times of the initial weight of the first SAP(s). In some non-limiting embodiments or aspects, an exemplary shielding material can include third SAP(s) that can absorb a weight amount of liquid(s) that is at least 1,000 times of the initial weight of the first SAP(s). In some non-limiting embodiments or aspects, an exemplary shielding material can include fourth SAP(s) that can absorb a weight amount of liquid(s) that is at least 10,000 times of the initial weight of the first SAP(s). In some non-limiting embodiments or aspects, an exemplary shielding material can include second SAP(s) that can absorb a weight amount of liquid(s) that is at least 100,000 times of the initial weight of the first SAP(s). In some non-limiting embodiments or aspects, an exemplary shielding material can include third SAP(s) that can absorb a weight amount of liquid(s) that is at least 1,000,000 times of the initial weight of the first SAP(s). In some non-limiting embodiments or aspects, an exemplary shielding material can include fourth SAP(s) that can absorb a weight amount of liquid(s) that is at least 10,000,000 times of the initial weight of the first SAP(s).

In some embodiments or aspects, the radiation shielding material may have a combination of different SAP materials having different absorbance capacities. The SAP-based shielding material may also be suitable for shielding neutron radiation.

In some embodiments or aspects, the liquid that is absorbed by a SAP may be a water or a water-based solution. Using SAP's a small volume and mass of material can be transported with a mobile or modular facility. By simply adding water or a water-based solution, the desired results of shielding can be easily achieved.

In some non-limiting embodiments, an exemplary shielding material may include a non-Newtonian fluid with a viscosity in a range of 0.001-0.01 mPa-s at zero applied stress. In some non-limiting embodiments, an exemplary shielding material may include a non-Newtonian fluid with a viscosity in a range of 0.01-0.1 mPa-s at zero applied stress. In some non-limiting embodiments, an exemplary shielding material may include a non-Newtonian fluid with a viscosity in a range of 0.1-1 mPa-s at zero applied stress. In some non-limiting embodiments, an exemplary shielding material may include a non-Newtonian fluid with a viscosity in a range of 1-10 mPa-s at zero applied stress. In some non-limiting embodiments, an exemplary shielding material may include a non-Newtonian fluid with a viscosity in a range of 10-100 mPa-s at zero applied stress. In some non-limiting embodiments, an exemplary shielding material may include a non-Newtonian fluid with a viscosity in a range of 100-1000 mPa-s at zero applied stress. In some non-limiting embodiments, an exemplary shielding material may include a non-Newtonian fluid with a viscosity in a range of $10^3$-$10^4$ mPa-s at zero applied stress. In some non-limiting embodiments, an exemplary shielding material may include a non-Newtonian fluid with a viscosity in a range of $10^4$-$10^5$ mPa-s at zero applied stress. In some non-limiting embodiments, an exemplary shielding material may include a non-Newtonian fluid with a viscosity in a range of $10^5$-$10^6$ mPa-s at zero applied stress. In some non-limiting embodiments, an exemplary shielding material may include a non-Newtonian fluid with a viscosity in a range of $10^6$-$10^7$ mPa-s at zero applied stress. In some non-limiting embodiments, an exemplary shielding material may include a non-Newtonian fluid with a viscosity in a range of $10^7$-$10^8$ mPa-s at zero applied stress. In some non-limiting embodiments, an exemplary shielding material may include a non-Newtonian fluid with a viscosity in a range of $10^8$-$10^9$ mPa-s at zero applied stress. In some non-limiting embodiments, an exemplary shielding material may include a non-Newtonian fluid with a viscosity in a range of $10^9$-$10^{10}$ mPa-s at zero applied stress. In some non-limiting embodiments, an exemplary shielding material may include a non-Newtonian fluid with a viscosity in a range of $10^{10}$-$10^{11}$ mPa-s at zero applied stress. In some non-limiting embodiments, an exemplary shielding material may include a non-Newtonian fluid with a viscosity in a range of $10^{11}$-$10^{12}$ mPa-s at zero applied stress. In some non-limiting embodiments, an exemplary shielding material may include a non-Newtonian fluid with a viscosity in a range of $10^{12}$-$10^{13}$ mPa-s at zero applied stress. In some non-limiting embodiments, an exemplary shielding material may include a non-Newtonian fluid with a viscosity in a range of $10^{13}$-$10^{14}$ mPa-s at zero applied stress. In some non-limiting embodiments, an exemplary shielding material may include a non-Newtonian fluid with a viscosity in a range of $10^{14}$-$10^{15}$ mPa-s at zero applied stress. In some non-limiting embodiments, an exemplary shielding material may include a non-Newtonian fluid with a viscosity in a range of $10^{15}$-$10^{16}$ mPa-s at zero applied stress.

In some non-limiting embodiments, the applied stress to the non-Newtonian fluid in the exemplary shielding material may be a shearing stress with a sheer rate in the range of $10^{-6}$-$10^{-5}$ $s^{-1}$. In some non-limiting embodiments, the applied stress to the non-Newtonian fluid in the exemplary shielding material may be a shearing stress with a sheer rate in the range of $10^{-5}$-$10^{-4}$ $s^{-1}$. In some non-limiting embodiments, the applied stress to the non-Newtonian fluid in the exemplary shielding material may be a shearing stress with a sheer rate in the range of $10^{-4}$-$10^{-3}$ $s^{-1}$. In some non-limiting embodiments, the applied stress to the non-Newtonian fluid in the exemplary shielding material may be a shearing stress with a sheer rate in the range of $10^{-3}$-$10^{-2}$ $s^{-1}$. In some non-limiting embodiments, the applied stress to the non-Newtonian fluid in the exemplary shielding material may be a shearing stress with a sheer rate in the range of $10^{-2}$-$10^{-1}$ $s^{-1}$. In some non-limiting embodiments, the applied stress to the non-Newtonian fluid in the exemplary shielding material may be a shearing stress with a sheer rate in the range of $10^{-1}$-1 $s^{-1}$. In some non-limiting embodiments, the applied stress to the non-Newtonian fluid in the exemplary shielding material may be a shearing stress with a sheer rate in the range of 1-10 $s^{-1}$. In some non-limiting embodiments, the applied stress to the non-Newtonian fluid in the exemplary shielding material may be a shearing stress with a sheer rate in the range of 10-100 $s^{-1}$. In some non-limiting embodiments, the applied stress to the non-Newtonian fluid in the exemplary shielding material may be a shearing stress with a sheer rate in the range of $10^{2}$-$10^{3}$ $s^{-1}$. In some non-limiting embodiments, the applied stress to the non-Newtonian fluid in the exemplary shielding material may be a shearing stress with a sheer rate in the range of $10^{2}$-$10^{3}$ $s^{-1}$. In some non-limiting embodiments, the applied stress to the non-Newtonian fluid in the exemplary shielding material may be a shearing stress with a sheer rate in the range of $10^{3}$-$10^{4}$ $s^{-1}$. In some non-limiting embodiments, the applied stress to the non-Newtonian fluid in the exemplary shielding material may be a shearing stress with a sheer rate in the range of $10^{4}$-$10^{5}$ $s^{-1}$. In some non-limiting embodiments, the applied stress to the non-Newtonian fluid in the exemplary shielding material may be a shearing stress with a sheer rate in the range of $10^{5}$-$10^{6}$ $s^{-1}$. In some non-limiting embodiments, the applied stress to the non-Newtonian fluid in the exemplary shielding material may be a shearing stress with a sheer rate in the range of $10^{6}$-$10^{7}$ $s^{-1}$.

In some non-limiting embodiments, an exemplary shielding material may include a non-Newtonian fluid with that exhibits a change in viscosity by a factor of $10^{-6}$-$10^{-5}$ with applied stress. In some non-limiting embodiments, an exemplary shielding material may include a non-Newtonian fluid with that exhibits a change in viscosity by a factor of $10^{-5}$-$10^{-4}$ with applied stress. In some non-limiting embodiments, an exemplary shielding material may include a non-Newtonian fluid with that exhibits a change in viscosity by a factor of $10^{-4}$-$10^{-3}$ with applied stress. In some non-limiting embodiments, an exemplary shielding material may include a non-Newtonian fluid with that exhibits a change in viscosity by a factor of $10^{-3}$-$10^{-2}$ with applied stress. In some non-limiting embodiments, an exemplary shielding material may include a non-Newtonian fluid with that exhibits a change in viscosity by a factor of $10^{-2}$-$10^{-1}$ with applied stress. In some non-limiting embodiments, an exemplary shielding material may include a non-Newtonian fluid with that exhibits a change in viscosity by a factor of $10^{-1}$-1 with applied stress. In some non-limiting embodiments, an exemplary shielding material may include a non-Newtonian fluid with that exhibits a change in viscosity by a factor of 1-10 with applied stress. In some non-limiting embodiments, an exemplary shielding material may include a non-Newtonian fluid with that exhibits a change in viscosity by a factor of 10-100 with applied stress. In some non-limiting embodiments, an exemplary shielding material may include a non-Newtonian fluid with that exhibits a change in viscosity by a factor of 100-1000 with applied stress. In some non-limiting embodiments, an exemplary shielding material may include a non-Newtonian fluid with that exhibits a change in viscosity by a factor of $10^{3}$-$10^{4}$ with applied stress. In some non-limiting embodiments, an exemplary shielding material may include a non-Newtonian fluid with that exhibits a change in viscosity by a factor of $10^{4}$-$10^{5}$ with applied stress. In some non-limiting embodiments, an exemplary shielding material may include a non-Newtonian fluid with that exhibits a change in viscosity by a factor of $10^{5}$-$10^{6}$ with applied stress.

In some embodiments, the radiation shielding material may have a combination of different non-Newtonian fluids having different radiation absorbance capacities. The radiation shielding material may also be suitable for shielding neutron radiation.

Variations, modifications and alterations to embodiments or aspects of the present disclosure described above will make themselves apparent to those skilled in the art. All such variations, modifications, alterations and the like are intended to fall within the spirit and scope of the present disclosure, limited solely by the appended claims.

While several embodiments or aspects of the present disclosure have been described, it is understood that these embodiments or aspects are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A shielding facility comprising:

a plurality of transportable modules connectable to form a containment area and to define a radiation barrier, each of the plurality of transportable modules comprising:

a first radiation wall defining the containment area;

a second radiation wall spaced apart from the second wall; and a radiation shielding fill material positioned between the first radiation shielding wall and the second radiation shielding wall, wherein the radiation shielding fill material comprises a superabsorbent polymer (SAP) filling a portion of a void between the first radiation wall and the second radiation wall, and wherein a quantity of the radiation shielding fill material is sufficient to reduce measurable ionizing radiation level outside the containment area when a remainder of the void is filled with a liquid such that the SAP absorbs at least a portion of the liquid.

2. The shielding facility according to claim 1, wherein the plurality of transportable modules comprises one or more sidewall modules connectable together to define vertical walls of the shielding facility and one or more roof modules connectable to an upper end of the one or more sidewall modules.

3. The shielding facility according to claim 2, further comprising at least one truss spanning between opposing sidewall modules and configured for supporting at least one of the one or more roof modules.

4. The shielding facility according to claim 2, further comprising a foundation having a plurality of elongated beams arranged in a pattern corresponding to a floor plan of the shielding facility, wherein each of the elongated beams is configured for supporting the one or more sidewall modules.

5. The shielding facility according to claim 2, further comprising a shielded door on at least one of the sidewall modules.

6. The shielding facility according to claim 1, wherein a thickness of each of the plurality of transportable modules is 0.5 meter to 6 meters.

7. The shielding facility according to claim 1, further comprising at least a second set of transportable modules surrounding the plurality of transportable modules.

8. The shielding facility according to claim 1, wherein the SAP is a synthetic SAP, a semi-synthetic SAP, or a natural SAP.

9. The shielding facility according to claim 1, wherein the SAP comprises elements configured for enhancing an absorption of radiative energy.

10. A shielding facility comprising:

a plurality of transportable modules connectable to form a containment area and to define a radiation barrier, each of the plurality of transportable modules comprising:

a first radiation wall defining the containment area;

a second radiation wall spaced apart from the second wall; and a radiation shielding fill material positioned between the first radiation shielding wall and the second radiation shielding wall, wherein the radiation shielding fill material comprises a non-Newtonian fluid filling a void between the first radiation wall and the second radiation wall, and wherein the non-Newtonian fluid is configured to reduce measurable ionizing radiation level outside the containment area.

11. The shielding facility according to claim 10, wherein the plurality of transportable modules comprises one or more sidewall modules connectable together to define vertical walls of the shielding facility and one or more roof modules connectable to an upper end of the one or more sidewall modules.

12. The shielding facility according to claim 11, further comprising at least one truss spanning between opposing sidewall modules and configured for supporting at least one of the one or more roof modules.

13. The shielding facility according to claim 11, further comprising a foundation having a plurality of elongated beams arranged in a pattern corresponding to a floor plan of the shielding facility, wherein each of the elongated beams is configured for supporting the one or more sidewall modules.

14. The shielding facility according to claim 11, further comprising a shielded door on at least one of the sidewall modules.

15. The shielding facility according to claim 10, wherein a thickness of each of the plurality of transportable modules is 0.5 meter to 6 meters.

16. The shielding facility according to claim 10, further comprising at least a second set of transportable modules surrounding the plurality of transportable modules.

17. The shielding facility according to claim 10, wherein the non-Newtonian fluid is a rheopectic fluid, a thixotropic fluid, a dilatant fluid, a pseudoplastic fluid, or any combination thereof.

18. The shielding facility according to claim 10, wherein the non-Newtonian fluid has ballistic- and blast-proof properties.

19. A method of constructing a modular shielding facility, the method comprising:

connecting a plurality of transportable modules to form a containment area and define a radiation barrier, each of the plurality of transportable modules comprising:

a first radiation wall defining the containment area; and a second radiation wall spaced apart from the second wall; and filling a void between the first radiation shielding wall and the second radiation shielding wall with a radiation shielding fill material, wherein the radiation shielding fill material comprises one of a superabsorbent polymer (SAP) filling a portion of a void between the first radiation wall and the second radiation wall and a non-Newtonian fluid filling the entire void between the first radiation wall and the second radiation wall.

20. The method according to claim 19, further comprising removing at least a portion of the radiation shielding fill material from the void prior to disassembling the plurality of modules.

* * * * *